US011203201B2

(12) United States Patent
Shiori et al.

(10) Patent No.: US 11,203,201 B2
(45) Date of Patent: Dec. 21, 2021

(54) IMAGE RECORDING APPARATUS, IMAGE RECORDING METHOD, AND RECORDING MEDIUM

(71) Applicants: Jun Shiori, Kanagawa (JP); Takuya Murata, Tokyo (JP); Takahisa Koike, Tokyo (JP); Hiroyuki Kiguchi, Kanagawa (JP); Ko Tokumaru, Tokyo (JP); Yuji Tanaka, Kanagawa (JP)

(72) Inventors: Jun Shiori, Kanagawa (JP); Takuya Murata, Tokyo (JP); Takahisa Koike, Tokyo (JP); Hiroyuki Kiguchi, Kanagawa (JP); Ko Tokumaru, Tokyo (JP); Yuji Tanaka, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/777,913

(22) Filed: Jan. 31, 2020

(65) Prior Publication Data

US 2020/0247113 A1 Aug. 6, 2020

(30) Foreign Application Priority Data

Feb. 5, 2019 (JP) ..... JP2019-019137

(51) Int. Cl.
*B41J 2/045* (2006.01)
*B41J 3/36* (2006.01)

(52) U.S. Cl.
CPC ..... *B41J 2/04595* (2013.01); *B41J 2/0451* (2013.01); *B41J 2/0454* (2013.01); (Continued)

(58) Field of Classification Search
CPC .. B41J 2/04506; B41J 2/04508; B41J 2/0451; B41J 2/04535; B41J 2/04536; B41J 2/0454; B41J 2/04551; B41J 2/04553; B41J 2/04558; B41J 2/04566; B41J 2/04593; B41J 2/04595; B41J 3/36
See application file for complete search history.

(56) References Cited

U.S. PATENT DOCUMENTS

2008/0138094 A1 6/2008 Shiori et al.
2008/0211864 A1 9/2008 Mealy et al.
(Continued)

FOREIGN PATENT DOCUMENTS

JP 2010-520086 6/2010
JP 2018-144337 9/2018

*Primary Examiner* — Matthew Luu
*Assistant Examiner* — Kendrick X Liu
(74) *Attorney, Agent, or Firm* — Xsensus LLP

(57) ABSTRACT

An image recording apparatus includes a recording head including a plurality of nozzles from which ink is ejected, a memory, and one or more hardware processors coupled to the recording head and the memory. The one or more hardware processors are configured to: determine, for each of the plurality of nozzles, whether a position of the corresponding nozzle is a position to eject ink; determine whether a successive ejection operation is necessary for a nozzle out of the plurality of nozzles, whose position is determined as the position to eject ink; and cause ink to be successively ejected at the position to eject ink at a predetermined successive ejection frequency from the nozzle that is determined to have the necessity of the successive ejection operation.

17 Claims, 14 Drawing Sheets

(52) U.S. Cl.
CPC ..... *B41J 2/04505* (2013.01); *B41J 2/04506* (2013.01); *B41J 2/04508* (2013.01); *B41J 2/04535* (2013.01); *B41J 2/04536* (2013.01); *B41J 2/04551* (2013.01); *B41J 2/04553* (2013.01); *B41J 2/04558* (2013.01); *B41J 2/04566* (2013.01); *B41J 2/04593* (2013.01); *B41J 3/36* (2013.01)

(56) References Cited

U.S. PATENT DOCUMENTS

| | | | | |
|---|---|---|---|---|
| 2009/0027991 | A1 | 11/2009 | Shiori | |
| 2011/0026958 | A1 | 2/2011 | Shiori | |
| 2011/0211854 | A1 | 9/2011 | Shiori et al. | |
| 2011/0298862 | A1 | 12/2011 | Mealy et al. | |
| 2012/0045235 | A1 | 2/2012 | Shiori et al. | |
| 2012/0093528 | A1 | 4/2012 | Shiori et al. | |
| 2012/0230711 | A1 | 9/2012 | Shiori et al. | |
| 2012/0299995 | A1 | 11/2012 | Mealy et al. | |
| 2013/0155146 | A1 | 6/2013 | Mealy et al. | |
| 2016/0342134 | A1 | 11/2016 | Shiori et al. | |
| 2018/0250948 | A1* | 9/2018 | Harada | B41J 2/16579 |
| 2019/0255779 | A1* | 8/2019 | Blomaard | B33Y 50/02 |
| 2019/0366622 | A1* | 12/2019 | Blomaard | B29C 64/112 |

* cited by examiner

IMAGE RECORDING APPARATUS, IMAGE RECORDING METHOD, AND RECORDING MEDIUM

CROSS-REFERENCE TO RELATED APPLICATIONS

The present application claims priority under 35 U.S.C. § 119 to Japanese Patent Application No. 2019-019137, filed on Feb. 5, 2019. The contents of which are incorporated herein by reference in their entirety.

BACKGROUND OF THE INVENTION

1. Field of the Invention

The present invention relates to an image recording apparatus, an image recording method, and a recording medium.

2. Description of the Related Art

With the downsizing of laptop personal computers (PC) and the rapid spread of smart devices represented by smartphones, downsizing and portability are one of principal demands for printers. For example, a hand-held printer, in which a paper conveying mechanism is omitted, has already been known. Such a hand-held printer applies ink to a printing medium, such as paper, while scanning on the paper by means of a manual operation of a user. The hand-held printer receives image data from a device (for example, a smart device, such as a smartphone, or a PC) that outputs image data, is scanned freehand on a flat plane on a printing medium (for example, a notebook or a fixed-size paper), and forms (records) an image.

In general inkjet printers, due to dryness of a nozzle surface of an inkjet head, ink adheres to the nozzle surface and may cause nozzle clogging. As a result, ink is not ejected at the time of printing in some cases. For preventing this problem, a dry prevention cap is often attached to the nozzle. However, it is not always possible to prevent the clogging even if it is structured to remove the cap only at the time of printing. To solve this problem, common serial printers perform an idle ejection before printing. That is, a process of removing the clogging by ejecting ink to a waste liquid tank is performed in advance so that ink can be normally ejected on the printing medium.

As a hand-held printer having the above-described structure to eliminate nozzle clogging, a printer provided with an inkjet cap and a wiper that wipes a nozzle has been disclosed (for example, Japanese Translation of PCT International Application Publication No. JP-T-2010-520086).

In the hand-held printer having the above-described structure, however, the nozzle clogging cannot be eliminated completely, and another problem that causes an extra work of an operation prior to printing by a user to perform wiping may arise. Furthermore, if the ejection operation is automatically performed similarly to the common serial printers, ink is wasted on a printing medium, and there is a problem that an unnecessary line is printed on the printing medium. Furthermore, when a user performs the idle ejection operation to eliminate the nozzle clogging on a place other than a printing medium (for example, on a waste paper sheet), it is to be an additional operation prior to printing by the user, and it results in causing a problem that the usability is reduced.

SUMMARY OF THE INVENTION

An image recording apparatus according to one aspect of the present invention includes a recording head including a plurality of nozzles from which ink is ejected, a memory, and one or more hardware processors coupled to the recording head and the memory. The one or more hardware processors are configured to: determine, for each of the plurality of nozzles, whether a position of the corresponding nozzle is a position to eject ink; determine whether a successive ejection operation is necessary for a nozzle out of the plurality of nozzles, whose position is determined as the position to eject ink; and cause ink to be successively ejected at the position to eject ink at a predetermined successive ejection frequency from the nozzle that is determined to have the necessity of the successive ejection operation.

BRIEF DESCRIPTION OF THE DRAWINGS

The accompanying drawings are intended to depict exemplary embodiments of the present invention and should not be interpreted to limit the scope thereof. Identical or similar reference numerals designate identical or similar components throughout the various drawings.

DESCRIPTION OF THE EMBODIMENTS

Figure 1:
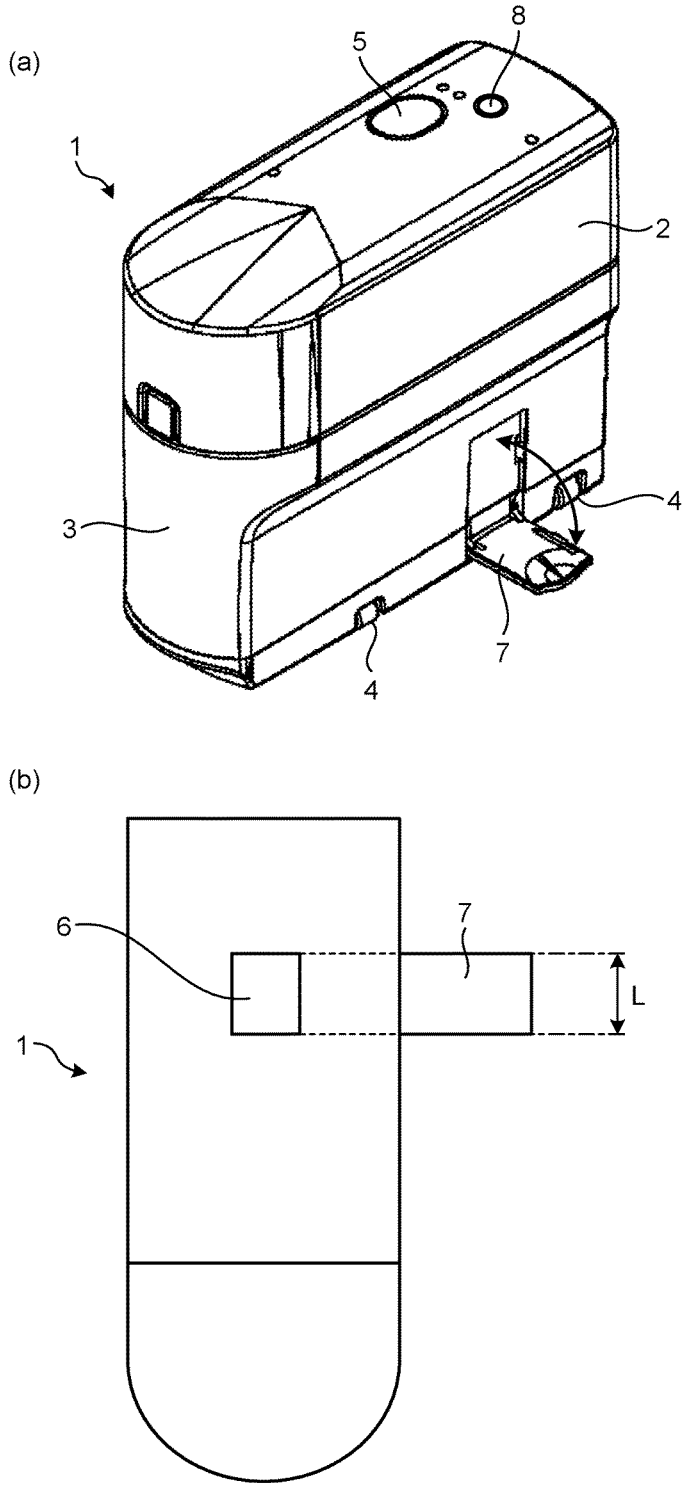
FIG. 1 is an external perspective view of a hand-held printer according to an embodiment.

The terminology used herein is for the purpose of describing particular embodiments only and is not intended to be limiting of the present invention.

As used herein, the singular forms "a", "an" and "the" are intended to include the plural forms as well, unless the context clearly indicates otherwise.

In describing preferred embodiments illustrated in the drawings, specific terminology may be employed for the sake of clarity. However, the disclosure of this patent specification is not intended to be limited to the specific terminology so selected, and it is to be understood that each specific element includes all technical equivalents that have the same function, operate in a similar manner, and achieve a similar result.

An embodiment of the present invention will be described in detail below with reference to the drawings.

An object of the present invention is to provide an image recording apparatus, an image recording method, and a recording medium, each being capable of ensuring the readability of printing without the idle ejection operation prior to the printing.

Hereinafter, an embodiment of an image recording apparatus, an image recording method, and a recording medium according to the present invention will be described in detail, referring to FIG. 1 to FIG. 14. Moreover, the following embodiment is not intended to limit the present invention, and components in the following embodiment include ones easily thought of by those skilled in the art, substantially the same elements, and ones in a range of so-called equivalents. Furthermore, various forms of omission, replacement, alteration, and combination of the components are possible within a range not departing from a scope of the gist of the following embodiments.

External View Structure of Hand-Held Printer

FIG. 1 is an external perspective view of a hand-held printer according to the embodiment. An external view structure of a hand-held printer 1 according to the present embodiment will be described, with referring to FIG. 1.

As illustrated in FIG. 1(*a*), the hand-held printer 1 includes an upper unit 2 and a lower unit 3.

The upper unit 2 is internally provided with a control board. On an upper surface of the upper unit 2, an operating button 5 to perform various kinds of operations and a light emitting diode (LED) 8 to indicate an operating state of the hand-held printer 1 are provided.

The operating button 5 is a button to perform by a user an operation such as a normal print operation. The LED 8 is a light emitting device for indicating an operating state of the hand-held printer 1, such as a state where normal printing is in process or a state where image data reception is in process.

The lower unit 3 includes a recording head (described later) that ejects ink. Moreover, the lower unit 3 is provided with a guide roller 4 to support movement in a left and right direction (a scanning direction) of a main body of the hand-held printer 1 and a guide member 7 that is provided on a side surface of one side of the lower unit 3.

The guide member 7 is a member used for recognizing a print area printed on a printing medium at the time of print operation. FIG. 1(*a*) illustrates a state where the guide member 7 is released from the side surface. In order to recognize a print area by using the guide member 7, the guide member 7 is brought to a released state as illustrated in FIG. 1(*a*). The guide member 7 is retracted into the main body on the side surface, when it is not used, by being rotated about a lower end of the guide member 7 in a hinge structure.

Moreover, the hand-held printer 1 is provided with an opening 6 that opens at a lower surface of the lower unit 3 as illustrated in FIG. 1(*b*). Ink, which has been jetted out from the recording head described later, reaches a printing medium such as a sheet of paper through the opening 6, and thereby image forming (image recording) is performed. As illustrated in FIG. 1(*b*), the guide member 7 is positioned on an extension of a line in the scanning direction from the opening 6, and a width L of the guide member 7 in a direction of length of the hand-held printer 1 is substantially the same as a width of the opening 6 in the same direction. This enables the user to recognize a print area based on the position of the guide member 7 when the hand-held printer 1 is scanned in the scanning direction (direction of width of the hand-held printer 1) during the print operation. Note that the guide member 7 may be formed with, for example, a transparent color. In this case, a printing state on the printing medium under the guide member 7 in the released position can be viewed during the print operation.

Print Scanning by Hand-Held Printer

Figure 2:
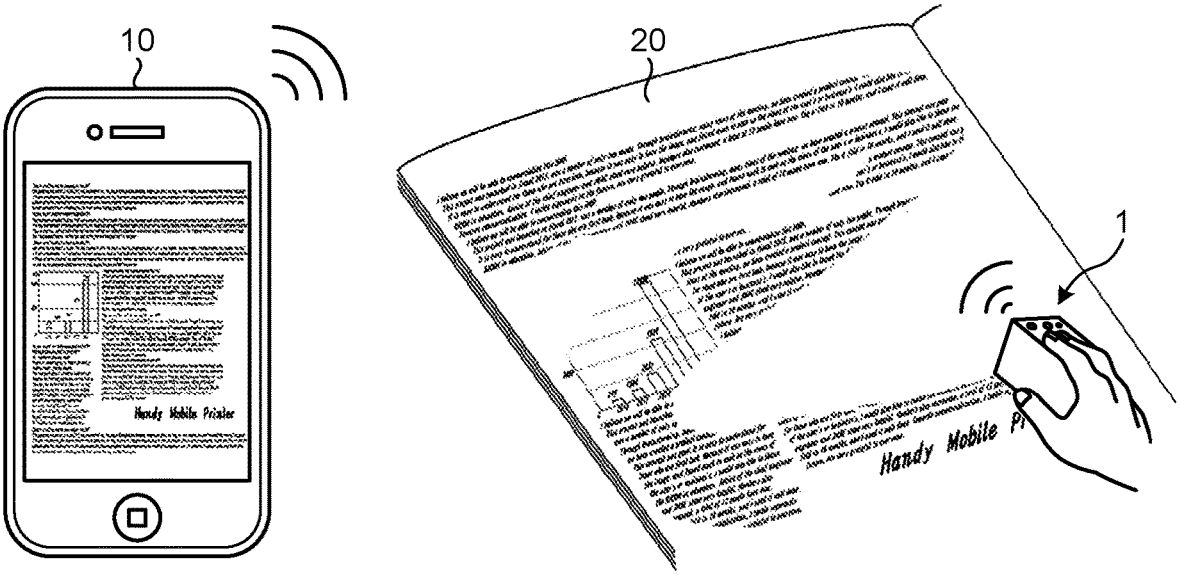
FIG. 2 is an illustration for explaining a print scanning state by using the hand-held printer according to the embodiment.

FIG. 2 is an illustration for explaining a print scanning state by using the hand-held printer according to the embodiment. Freehand print scanning by a user who is holding the hand-held printer 1 according to the present embodiment will be described with referring to FIG. 2.

As illustrated in FIG. 2, the hand-held printer 1 receives, from an external device 10, image data to be printed on a printing medium 20. The user decides an initial position on the printing medium 20 by operating the operating button 5 of the hand-held printer 1 and starts the print operation. As the initial position on the printing medium 20 is decided, the hand-held printer 1 can recognize a print position of the image data on the printing medium 20 with reference to the initial position. Furthermore, since the hand-held printer 1 is equipped with a navigation sensor that detects an amount of movement and with a gyro sensor that detects an angular speed as described later, the hand-held printer 1 is capable of recognizing its position and posture relative to the initial position. When the user carries out the freehand scanning with the hand-held printer 1 on the printing medium 20 as illustrated in FIG. 2, the hand-held printer 1 continues to calculate a position of each individual nozzle of the recording head, based on information about the position and the posture from the navigation sensor and the gyro sensor. Thus, it is possible to determine which part of the image data should be printed by which nozzle at each position on the printing medium 20. Therefore, by scanning the hand-held printer 1 freehand in free directions on the printing medium 2, the user is able to print on the printing medium 20 an image corresponding to the image data.

Hardware Configuration of Hand-Held Printer

Figure 3:
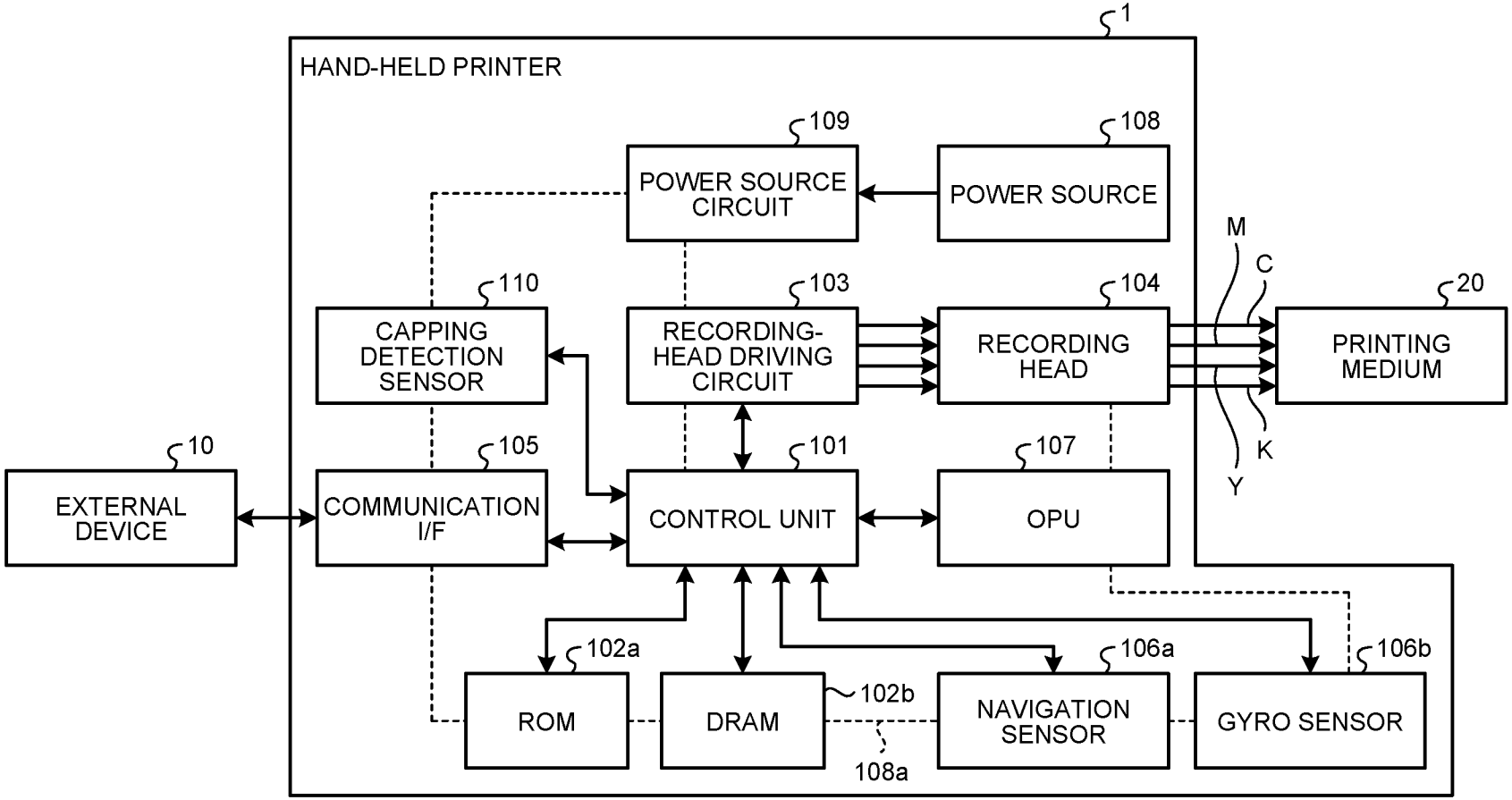
FIG. 3 illustrates an example of a hardware configuration of the hand-held printer according to the embodiment.
Figure 4:
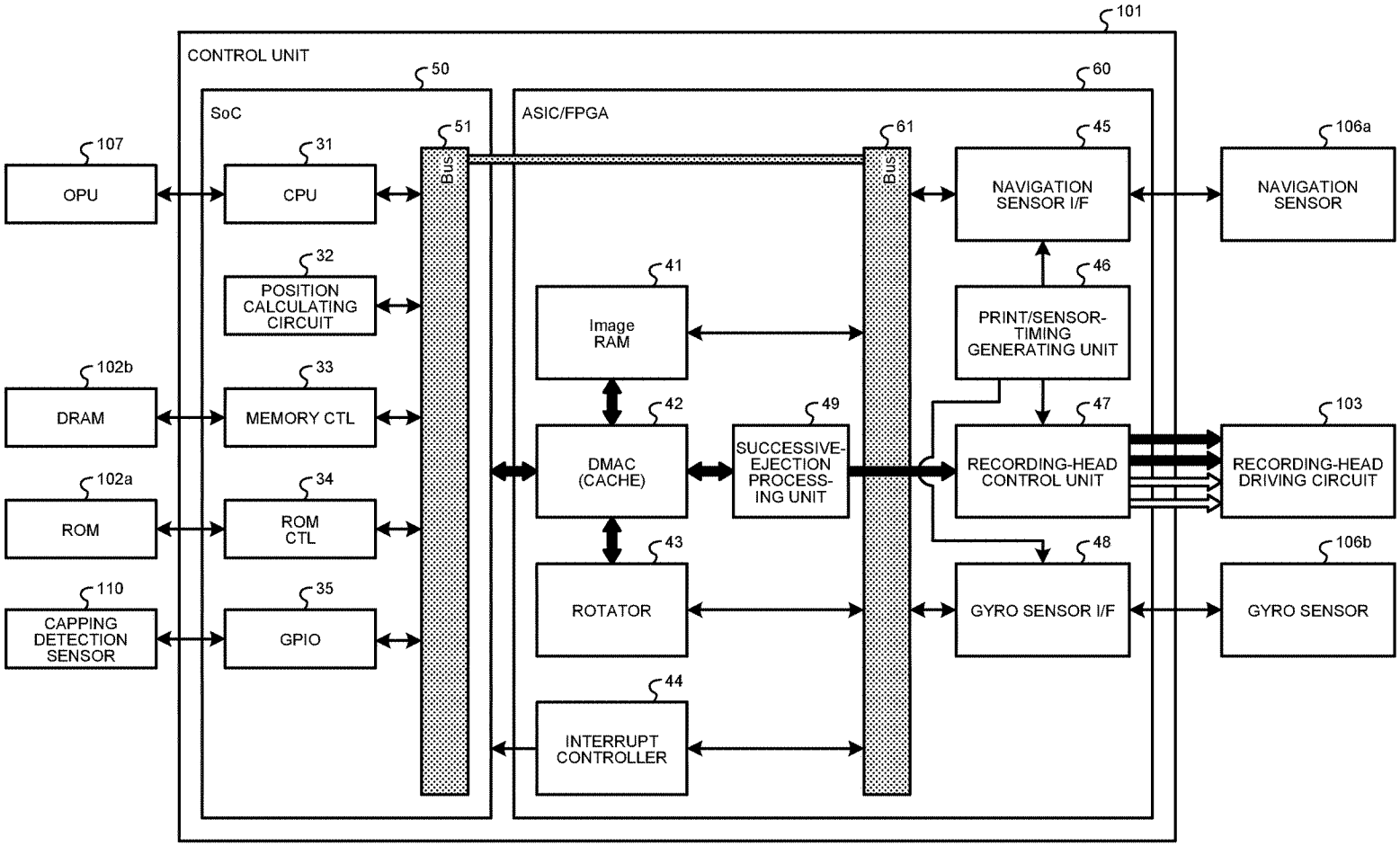
FIG. 4 illustrates an example of a configuration of a control unit of the hand-held printer according to the embodiment.

FIG. 3 illustrates an example of a hardware configuration of the hand-held printer according to the embodiment. FIG. 4 illustrates an example of a configuration of a control unit of the hand-held printer according to the embodiment. A hardware configuration of the hand-held printer 1 according to the embodiment will be described with referring to FIG. 3 and FIG. 4.

The hand-held printer 1 according to the present embodiment is an example of an image recording apparatus that forms an image on the printing medium 20. The entire movement of the hand-held printer 1 is controlled by a control unit 101. As illustrated in FIG. 3, the control unit 101 is electrically connected to a read-only memory (ROM) 102*a*, a dynamic random access memory (DRAM) 102*b*, a recording-head driving circuit 103, a communication interface (I/F) 105, a navigation sensor 106*a*, a gyro sensor 106*b*, an operation panel unit (OPU) 107, and a capping detection sensor 110. Moreover, the hand-held printer 1 is driven by the electric power, so that it includes a power source 108 and a power source circuit 109. The electric power generated by the power source circuit 109 is supplied to the control unit 101, the ROM 102*a*, the DRAM 102*b*, the recording-head driving circuit 103, a recording head 104, the communication I/F 105, the navigation sensor 106*a*, the gyro sensor 106*b*, the OPU 107, and the capping detection sensor 110 through wirings indicated by a dotted line 108*a* depicted in FIG. 3.

The power source 108 is mainly a battery. The power source 108 may be a solar cell, a commercial power supply (alternate current power supply), a fuel cell, or the like. The power source circuit 109 is a circuit that distributes an electric power supplied by the power source 108 to respective parts of the hand-held printer 1. Moreover, the power source circuit 109 steps down or steps up a voltage of the power source 108 to a suitable voltage for respective parts. Furthermore, when the power source 108 is a rechargeable battery, the power source circuit detects connection of an alternate-current power supply, to connect to a charge circuit of the buttery, thereby enabling to charge the power source 108.

The communication I/F 105 is an interface to receive image data from the external device 10, such as a smartphone and a PC. The communication I/F 105 is, for example, an interface that is compliant to a communication standard, such as wireless local area network (LAN), Bluetooth (registered trademark), a near field communication (NFC), infrared ray, 3G (mobile phone), or long-term evolution (LTE). Alternatively, the communication I/F 105 may be an interface that supports wired communication using wired LAN, universal serial bus (USB) cable, or the like, other than such a wireless communication.

The ROM 102*a* is a non-volatile memory device that stores a firmware to perform hardware control of the hand-held printer 1, driving waveform data of the recording head 104 data to specify voltage variations to eject ink), initial setting data of the hand-held printer 1, and the like.

The DRAM 102*b* is a non-volatile memory device that is used to store image data received by the communication I/F 105, or to store firmware developed from the ROM 102*a*. Therefore, the DRAM 102*b* is used as a work memory when a central processing unit (CPU) 31 illustrated in FIG. 4 executes the firmware.

The navigation sensor 106*a* is a sensor that detects an amount of movement of the hand-held printer 1 (amount of movement of the navigation sensor 106*a* itself) for each predetermined cycle time. The navigation sensor 106*a* includes a light source, such as a light emitting diode (LED) or a laser, and an imaging sensor that images the printing medium 20. When the hand-held printer 1 is scanned on the printing medium 20, the navigation sensor 106*a* sequentially detects (images) minute edges of the printing medium 20 and acquires an amount of movement by analyzing a distance between the edges. In the present embodiment, only a single unit of the navigation sensor 106*a* is mounted on a bottom surface of the hand-held printer 1. Note that a multi-axis acceleration sensor may be used as the navigation sensor 106*a*, and the hand-held printer 1 may detect an amount of movement of the hand-held printer 1 only with the acceleration sensor.

The gyro sensor 106*b* is a sensor that detects an angular speed when the hand-held printer 1 rotates about an axis perpendicular to the printing medium 20. Details of the gyro sensor 106*b* will be described later.

The capping detection sensor 110 is a sensor that detects whether a nozzle unit of the recording head 104 in the hand-held printer 1 is capped with a dry prevention cap.

The OPU 107 is an operation display unit having an LED to indicate a state of the hand-held printer 1, a switch to instruct image formation to the hand-held printer 1 by a user, and the like. The OPU 107 corresponds to, for example, the operating button 5 and the LED 8 illustrated in FIG. 1. Note that it is not limited to this configuration. The OPU 107 includes a liquid crystal display, and may further include a touch panel. Moreover, the OPU 107 may have a voice input function.

The recording-head driving circuit 103 is a driving circuit that generates a driving waveform (voltage) to drive the recording head 104 by using the driving waveform data described above. The recording-head driving circuit 103 generates a driving waveform corresponding to a size of a droplet of ink, and the like.

The recording head 104 is a head to eject ink. While four colors "C", "M", "Y", and "K" of ink are enabled to be ejected in the example in FIG. 3, a single color or five or more colors of ink may be enabled to be ejected. The recording head 104 is provided with a plurality of nozzles to eject ink that are arranged in a row (may be arranged in two or more rows) per color. Moreover, a mode of ink ejection may be a piezo mode or a thermal mode, or may be another mode. The recording head 104 is a functional part that ejects or jets out liquid from the nozzles. The liquid jetted out is not particularly limited as long as it has such a viscosity and a surface tension that can be jetted out from the recording head 104, but it is preferable to have the viscosity becoming 30 [mPa·s] or smaller when heated or cooled at room temperature and normal pressure. More specifically, it may be a solvent, such as water and an organic solvent, a colorant, such as a dye and a pigment, a solution, a suspension, and an emulsion including a functionalized material, such as a polymerized compound, a resin, and a surfactant, a biocompatible material, such as DNA, amino acid, protein, and calcium, an edible material, such as a natural color, and the like, and these can be used as, for example, ink for inkjet, a surface treatment solution, a solution for forming a component of an electronic device and a light emitting diode, and a resist pattern of an electronic circuit, three-dimensional sculping material solution, and the like.

The control unit 101 is provided with the CPU 31 illustrated in FIG. 4. The control unit 101 is a control board that controls the entire hand-held printer 1. The control unit 101 performs determination on a position of each individual nozzle of the recording head 104, determination on an image to be formed based on the position, determination on whether an ejection condition described later is satisfied, and the like, based on the amount of movement detected by the navigation sensor 106*a* and the angular speed detected by the gyro sensor 106*b*. Details of the control unit 101 will be described later in FIG. 4.

The control unit 101 includes, as illustrated in FIG. 4, a system on a chip (SoC) 50 and an application specific integrated circuit (ASIC)/field programmable gate array (FPGA) 60. The SoC 50 and the ASIC/FPGA 60 communicate with each other through buses 51 and 61. The "ASIC/FPGA 60" means that it may be designed with either implementation technique (that is, either ASIC or FPGA is included in the control unit 101), and may be configured with another implementation technique other than the ASIC/FPGA 60. Furthermore, the SoC 50 and the ASIC/FPGA 60 may be formed in a single chip or board, without forming in separate chips. Alternatively, the SoC 50 and the ASIC/FPGA 60 may be implemented with three or more chips or boards.

The SoC 50 is provided with the CPU 31, a position calculating circuit 32, a memory controller (CTL) 33, a ROM CTL 34, a general-purpose input/output (GPIO) 35. Components of the SoC 50 are not limited to these ones.

The ASIC/FPGA 60 is provided with an image random-access memory (RAM) 41 connected through the bus 61, a direct memory access controller (DMAC) 42, a rotator 43, an interrupt controller 44, a navigation sensor I/F 45, a print/sensor-timing generating unit 46, a recording-head control unit 47, a gyro sensor I/F 48, and successive-ejection processing unit 49. Components of the ASIC/FPGA 60 are not limited to these ones.

The CPU 31 is an arithmetic device that executes firmware (program) developed on the DRAM 102*b* from the ROM 102*a*. The CPU 31 controls the position calculating circuit 32, the memory CTL 33, the ROM CTL 34, and the GPIO 35 in the SoC 50. Moreover, the CPU 31 controls the image RAM 41, the DMAC 42, the rotator 43, the interrupt controller 44, the navigation sensor I/F 45, the print/sensor-timing generating unit 46, the recording-head control unit 47, the gyro sensor I/F 48, and the successive-ejection processing unit 49 in the ASIC/FPGA 60.

The position calculating circuit 32 is an arithmetic circuit that calculates a position (coordinate information) and a posture of the hand-held printer 1 based on an amount of movement of each sampling period detected by the navigation sensor 106*a* and an angular speed of each sampling period detected by the gyro sensor 106*b*. The position of the hand-held printer 1 is, specifically, the position of the nozzle. When the position of the navigation sensor 106*a* is determined, the position of the nozzle can be calculated. Moreover, the position calculating circuit 32 calculates a target ejection position. The position calculating circuit 32 is not limited to be implemented as a hardware circuit, but it may be configured as function of the position calculating circuit 32, which is implemented by executing an operating program by the CPU 31.

The position of the navigation sensor 106*a* is calculated, for example, with reference to a predetermined origin (an initial position of the hand-held printer 1 at the time of starting image recording (image forming)). Moreover, the position calculating circuit 32 estimates a moving direction and speed based on a difference between a past position and a latest position, and estimates, for example, a position of the navigation sensor 106*a* at next ejection timing. Thus, ink can be ejected, suppressing a delay from scanning by the user.

The memory CTL 33 is an interface with the DRAM 102*b*. The memory CTL 33 requests data to the DRAM 102*b*, and sends acquired firmware to the CPU 31 or sends the acquired image data to the ASIC/FPGA 60.

The ROM CTL 34 is an interface with the ROM 102*a*. The ROM CTL 34 requests data to the ROM 102*a* or sends the acquired data to the CPU 31 and the ASIC/FPGA 60.

The GPIO 35 is an interface with the capping detection sensor 110. When the capping detection sensor 110 detects that the dry prevention cap is capped on the nozzle unit of the recording head 104, the GPIO 35 receives a detection signal representing the detection.

The image RAM 41 is a storage device that temporarily stores image data acquired by the DMAC 42. That is, in the image RAM 41, a certain amount of image data is buffered and is read out depending on a position of the hand-held printer 1.

The rotator 43 is an arithmetic circuit that rotates image data acquired by the DMAC 42 in accordance with positions of the recording head 104 and nozzles in the recording head 104, and an inclination of the head due to an assembly error. The DMAC 42 is a controller that outputs the rotated image data to the recording-head control unit 47.

The successive-ejection processing unit 49 is a processing circuit that, when an ejection condition to eject ink from a nozzle of the recording head 104 is satisfied and successive ejection is to be performed from the nozzle, controls the recording-head control unit 47 to perform a successive ejection operation from the nozzle in accordance with the ejection timing output from the print/sensor-timing generating unit 46, as described later. As illustrated in FIG. 4, the successive-ejection processing unit 49 is arranged as an independent hardware circuit, but it is not limited thereto. The successive-ejection processing unit 49 may be arranged to be included in the recording-head control unit 47, for example.

The recording-head control unit 47 is a control circuit that performs dither processing on image data (bitmap data) and converts the image data into a set of dots that expresses an image with size and density. The image data becomes data about ejection positions and sizes of dots. The recording-head control unit 47 outputs a control signal corresponding to the sizes of dots to the recording-head driving circuit 103. The recording-head driving circuit 103 generates a driving waveform (voltage) by using driving waveform data corresponding to the control signal described above.

The navigation sensor I/F 45 is an interface that communicates with the navigation sensor 106*a*. The navigation sensor I/F 45 receives an amount of movement as information from the navigation sensor 106*a* and stores a value of the movement amount in an internal register.

The print/sensor-timing generating unit 46 is a circuit that outputs an information reading timing of the navigation sensor I/F 45 and the gyro sensor I/F 48 and also outputs a driving timing to the recording-head control unit 47. A cycle of the information reading timing is longer than a cycle of the ejection timing of ink. The recording-head control unit 47 determines whether an ejection condition is satisfied. Then, the recording-head control unit 47 determines to eject ink when there is a target ejection position to which ink should be ejected, and determines not to eject ink out when there is no target ejection position.

The gyro sensor I/F 48 is an interface that acquires an angular speed detected by the gyro sensor 106*b* at the timing generated by the print/sensor-timing generating unit 46 and stores the value in the register.

The interrupt controller 44 detects completion of communication between the navigation sensor I/F 45 and the navigation sensor 106*a*, and outputs an interrupt signal to notify the SoC 50 of the completion. When this interrupt arises, the CPU 31 acquires an amount of movement from the internal register stored by the navigation sensor I/F 45. In addition, a function of notification of a status, such as an error notification, is also provided. Similarly, also for the gyro sensor I/F 48, the interrupt controller 44 outputs an interrupt signal to notify the SoC 50 of completion of communication with the gyro sensor 106*b*.

The hardware configuration of the hand-held printer 1 illustrated in FIG. 3 and FIG. 4 is only an example, and it may include components other than the components illustrated in FIG. 3 and FIG. 4. Moreover, the respective functions of the SoC 50 and the ASIC/FPGA 60 may be distributed to either of them depending on a performance of the CPU 31 and a circuit scale or the like of the ASIC/FPGA 60.

Method of Calculating Nozzle Position

Figure 5:
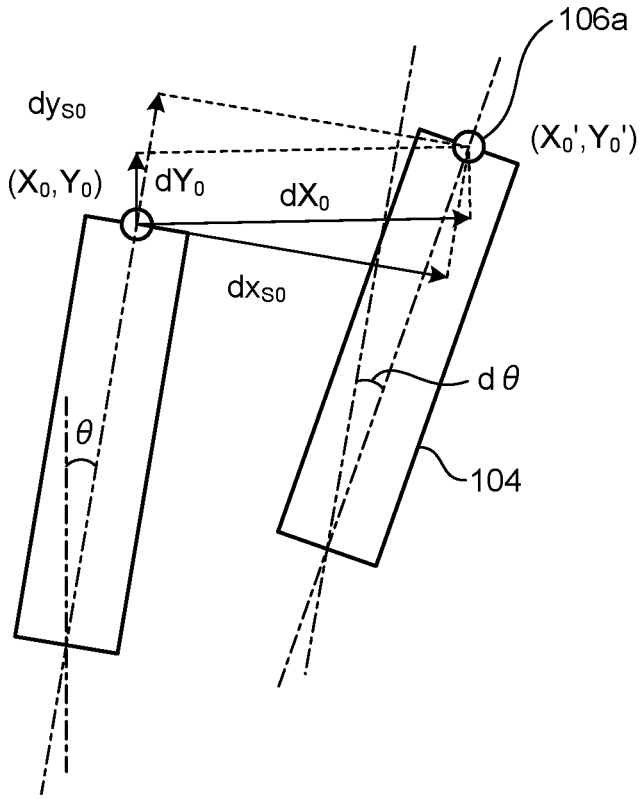
FIG. 5 illustrates an example of a method of calculating a position of a navigation sensor of the hand-held printer according to the embodiment.

FIG. 5 illustrates an example of a method of calculating a position of the navigation sensor of the hand-held printer according to the embodiment. An operation of acquiring a position of a nozzle of the recording head 104 by calculating a position of the navigation sensor 106*a* will be described with referring to FIG. 5.

In FIG. 5, it is assumed that an initial position of the navigation sensor 106*a* arranged in the recording head 104 of the hand-held printer 1 is (X0, Y0). Moreover, as illustrated in FIG. 5, it is assumed that a direction of length (for example, a column direction of columns of the nozzles) of the recording head 104 has an angle θ from a predetermined reference direction.

An angular speed ω of the hand-held printer 1 is detected by the gyro sensor 106*b*. This angular speed ω can be regarded as an angular speed of the navigation sensor 106*a*. The angular speed ω is calculated by Equation (1) below.

$$\omega = \frac{d\theta}{dt} \tag{1}$$

When dθ is regarded as an amount of variation per sampling period dt for the angle θ above, the amount of variation dθ is expressed by Equation (2) below.

$$d\theta = \omega \times dt \tag{2}$$

Therefore, when a time when the initial position described above is determined is t=0 and a current time is t=N, the current angle θ of the recording head 104 is calculated by Equation (3) below.

$$\theta = \sum_{t=0}^{N} \omega_t \times dt \tag{3}$$

Here, ωt denotes the angular speed ω at a time t. The position calculating circuit 32 calculates the angle θ as a current posture of the hand-held printer 1 from the angular speed ω detected by Equation (3) above by the gyro sensor 106*b*.

Moreover, a position ($X_0'$, $Y_0'$) of the navigation sensor 106*a* after movement (scanning) can be calculated by substituting the angle θ calculated by Equation (3) above to equations of $dX_0$ and $dY_0$.

$$dX_0 = dx_{s0} \times \cos\theta + dy_{s0} \times \sin\theta$$

$$dY_0 = -dx_{s0} \times \sin\theta + dy_{s0} \times \cos\theta$$

$$X_0' = X_0 + dX_0$$

$$Y_0' = Y_0 + dY_0 \tag{4}$$

Herein, as illustrated in FIG. 5, $dX_0$ denotes a displacement from the initial position ($X_0$, $Y_0$) in an X direction, and $dY_0$ denotes a displacement from the initial position in a Y direction. Moreover, $dy_{s0}$ denotes a displacement in the direction of length of the recording head 104, and $dx_{s0}$ denotes a displacement in a direction perpendicular to the direction of length. Accordingly, the navigation sensor 106*a* detects, for example, the displacements $dx_{s0}$ and $dy_{s0}$ for an amount of movement. The position calculating circuit 32 then calculates the displacements $dX_0$ and $dY_0$ after movement (scanning) as expressed in Equation (4) above by using the calculated angle θ and the displacements $dx_{s0}$ and $dy_{s0}$ detected by the navigation sensor 106*a*. Furthermore, the position calculating circuit 32 can calculate the position ($X_0'$, $Y_0'$) of the navigation sensor 106*a* after movement (scanning) by adding the calculated displacements $dX_0$ and $dY_0$ to the initial position ($X_0$, $Y_0$) as expressed in Equation (4) above.

Moreover, a relative positional relationship between the navigation sensor 106*a* and the recording head 104 is already given. Thus, the position calculating circuit 32 can calculate a position of each of the nozzles by using the calculated position ($X_0'$, $Y_0'$) of the navigation sensor 106*a*.

Overview of Successive Ejection Operation of Hand-Held Printer

Figure 6:
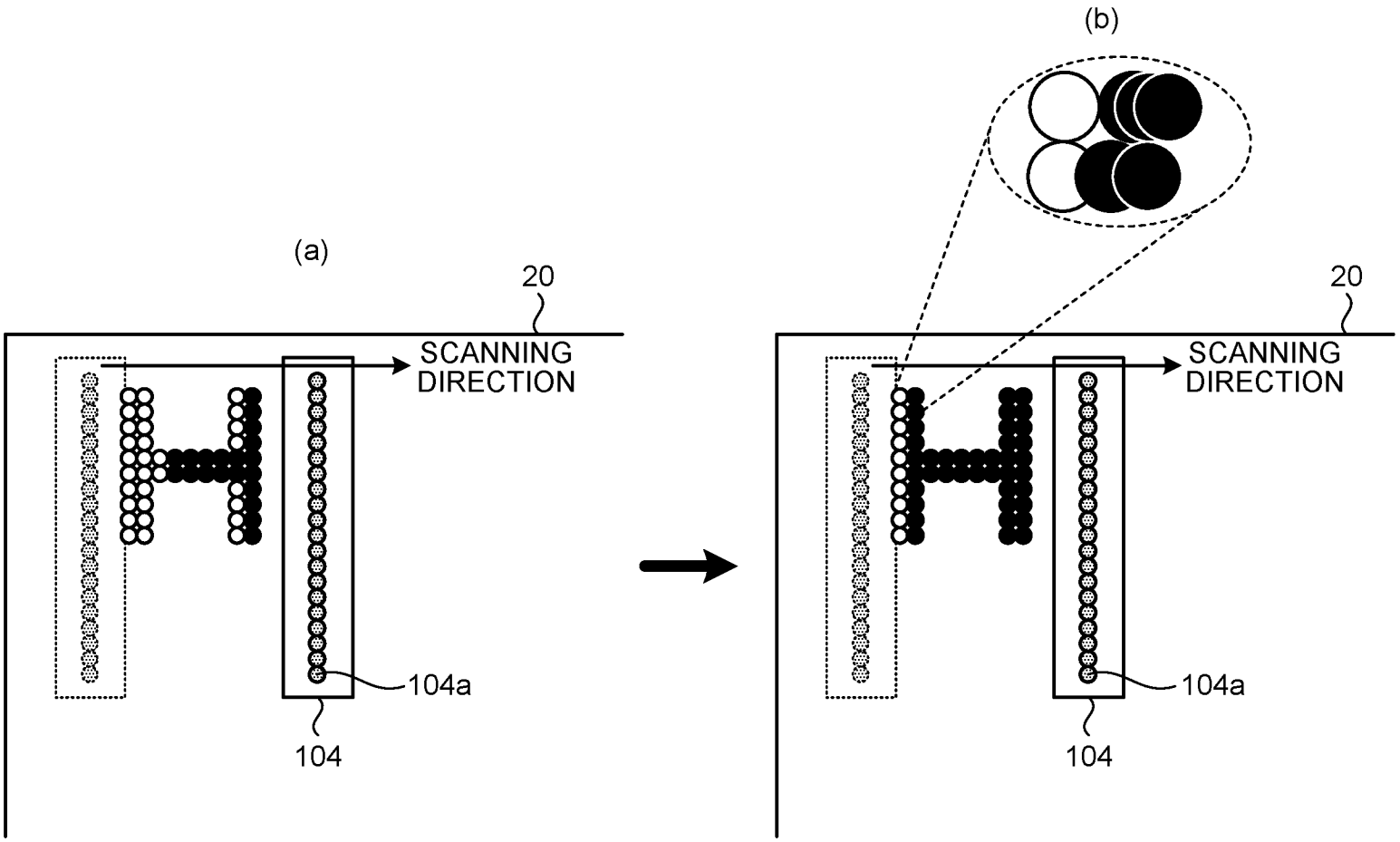
FIG. 6 is an illustration for explaining an overview of a print operation of the hand-held printer according to the embodiment.
Figure 7:
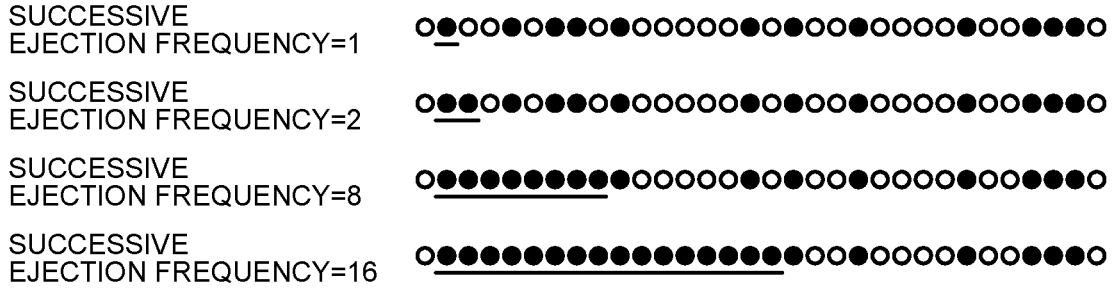
FIG. 7 is an illustration for explaining a successive ejection operation in the hand-held printer according to the embodiment.

FIG. 6 is an illustration for explaining an overview of a print operation of the hand-held printer according to the embodiment. FIG. 7 is an illustration for explaining a successive ejection operation in the hand-held printer according to the embodiment. The successive ejection operation of the hand-held printer 1 according to the present embodiment will be described with referring to FIG. 6 and FIG. 7.

In FIG. 6(*a*), it is assumed that an image of a letter "H" represented by image data is printed. Respective circles "○" and "●" forming the letter "H" illustrated in FIG. 6(*a*) indicate ejection positions to which ink is to be jetted out from nozzles 104*a* of the recording head 104. In a conventional ejection method, that is, in a conventional operation of single ejection from the nozzles 104*a* at respective ejection positions, there is a case where ink is not ejected even when an ejection operation from the nozzles 104*a* is performed at the ejection position when nozzle clogging has occurred in any of the nozzles 104*a*. An ejection position where the readability is deteriorated due to ejection failure of the nozzle 104*a* is indicated by an open circle "○", and an ejection position at which the nozzle clogging has been eliminated by several times of ejection operations and ink is ejected is indicated by a filled circle "●". As illustrated in FIG. 6(*a*), at an ejection start portion (a left-end portion of the letter "H"), ink has not been ejected normally due to nozzle clogging. Accordingly, although the image to be originally printed is the letter "H", an image that cannot be read as the letter "H" is printed, resulting in print with poor readability.

FIG. 6(*b*) illustrates a case where a successive ejection operation is performed by the hand-held printer 1 according to the present embodiment. The hand-held printer 1 according to the present embodiment performs the successive ejection operation to successively eject ink by a predetermined number of times (successive ejection frequency) at the same ejection position in an ejection start portion of an image to be printed. By performing the successive ejection operation, it is capable of eliminating clogging of ink in the course of the successive ejection operation and ejecting ink normally. As a result, as illustrated in FIG. 6(*b*), although it results in poor printing as a print result at the ejection position because an ejection failure occurs in a first half of the successive ejection operation at the ejection position in the ejection start portion of the letter "H", the nozzle clogging is eliminated near the ejection start portion. Therefore, the readability of the letter "H" can be secured. Moreover, it has been described above that ink is ejected successively at the same ejection position. However, since the hand-held printer 1 is being moved by the manual scan operation by the user in an actual situation, positions of the respective dots of ink in the successive ejection operation are to be displaced as illustrated in an enlarged view in FIG. 6(*b*).

The number of times of ejection per a successive ejection operation, that is, the successive ejection frequency described above is determined based on a state of the nozzle 104*a* (for example, how long time has elapsed since the previous printing). In FIG. 7, an example of dot sequences, which are printed with the successive ejection frequency of 1, 2, 8, and 16, is illustrated. The open circle "○" in FIG. 7 indicates a position at which ink is not ejected, and the filled circle "●" indicates a position at which ink is ejected. The filled circle "●" does not necessarily indicate a position at which ink is actually ejected because ink is not always ejected when nozzle clogging has occurred. However, in the hand-held printer 1 according to the present embodiment, as the successive ejection frequency increases in the successive ejection operation at the same ejection position, the possibility that the nozzle clogging is eliminated increases. Details of a method of determining the successive ejection frequency will be described later.

Figure 8:
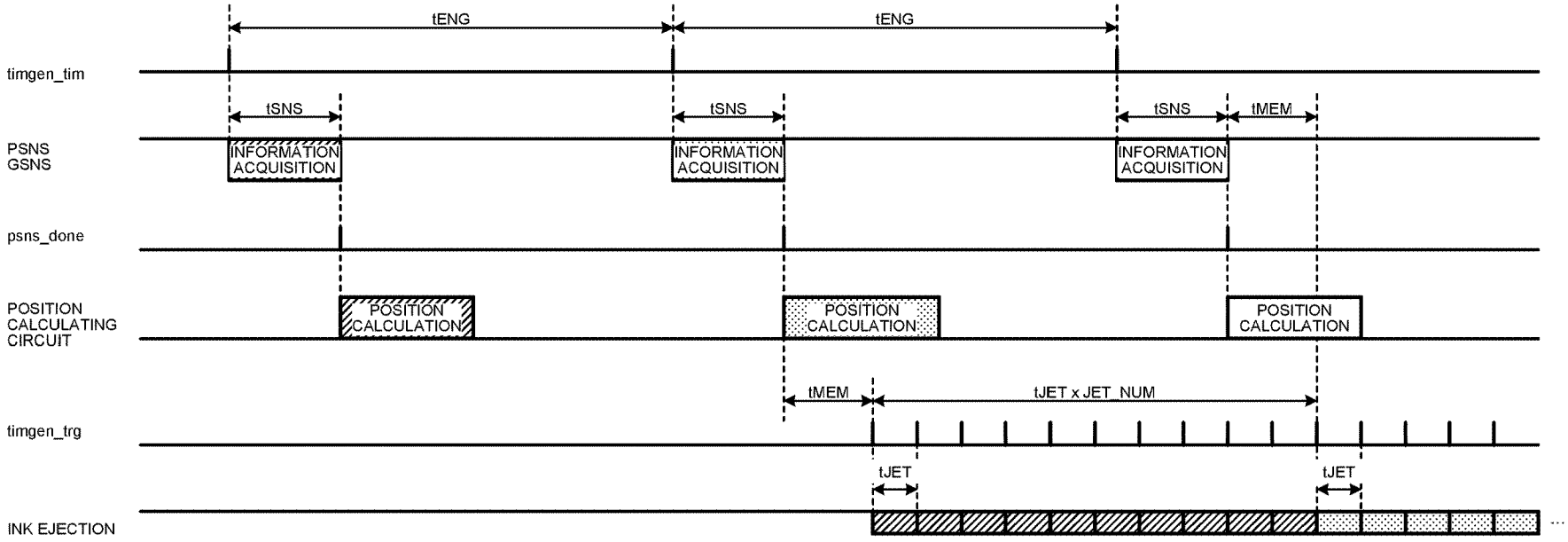
FIG. 8 illustrates a time chart of an ejection cycle of the hand-held printer according to the embodiment.

FIG. 8 is a time chart of an ejection cycle of the hand-held printer according to the embodiment. Timings of the respective processing in the successive ejection operation of the hand-held printer 1 according to the present embodiment will be described with referring to the time chart in FIG. 8.

As illustrated in FIG. 8, the print/sensor-timing generating unit 46 generates a timing signal timgen_tim for the navigation sensor I/F 45 and the gyro sensor I/F 48 to read information (angular speed, amount of movement) in a predetermined control cycle tENG from the navigation sensor 106*a* and the gyro sensor 106*b*, respectively.

Upon receiving the timing signal timgen_tim from the print/sensor-timing generating unit 46, the navigation sensor I/F 45 performs processing of acquiring information about an amount of movement from the navigation sensor 106*a* (information acquisition PSNS) at time tSNS. Moreover, upon receiving the timing signal timgen_tim from the print/sensor-timing generating unit 46, the gyro sensor I/F 48 performs processing of acquiring information about an angular speed from the gyro sensor 106*b* (information acquisition GSNS) at time tSNS. When the information acquisition is completed, the navigation sensor I/F 45 and the gyro sensor I/F 48 issue a completion signal psns_done. Note that it may be configured such that the completion signal psns_done may be issued by at least either one of the navigation sensor I/F 45 and the gyro sensor I/F 48.

When the completion signal psns_done is issued by the navigation sensor I/F 45 and the gyro sensor I/F 48, the interrupt controller 44 outputs an interrupt signal to the SoC 50. Upon detecting the interrupt signal, the position calculating circuit 32 of the SoC 50 calculates current postures and positions of the respective nozzles of the recording head 104, and also calculates estimated next (future) postures and positions of the respective nozzles from the amount of movement and the angular speed (hereinafter, it may be referred to as "posture position information") acquired by the navigation sensor I/F 45 and the gyro sensor I/F 48. Then, the position calculating circuit 32 sets information about the acquired postures and positions into the register of the rotator 43. The rotator 43 transfers peripheral images of the respective nozzles corresponding to the set posture position information from the DRAM 102*b* to the image RAM 41. When an ejection condition is satisfied, the recording-head control unit 47 outputs a control signal to the recording-head driving circuit 103 to eject ink from the recording head 104 in accordance with a timing signal timgen_trg generated by the print/sensor-timing generating unit 46. At this time, the ejection operation from the recording head 104 is started when time tMEM, which is a fixed value, passes from a calculation timing of the estimated posture position information based on the control signal from the recording-head control unit 47.

When the ejection condition is satisfied and a condition of starting the successive ejection operation is satisfied, the successive-ejection processing unit 49 causes the recording-head control unit 47 to perform the successive ejection operation of ink from the recording head 104 in accordance with the timing signal timgen_trg generated in a recording cycle tJET that is shorter than a cycle of normal single ejection as illustrated in FIG. 8. This recording cycle tJET is set based on a maximum value of a scanning speed of the hand-held printer 1 by the user and a resolution of the image, and is shorter than a cycle of normal single ejection cycle (for example, a control cycle tENG in FIG. 8). Accordingly, since the recording cycle tJET is shorter than the cycle of single ejection normally, a timing based on the timing signal timgen_trg output in intervals of the recording cycle tJET is a timing at which an ink ejection is not necessary in a normal operation. In the successive ejection operation, ink is to be successively ejected by utilizing timings at which an ink ejection is not necessary in the normal operation. In the example illustrated in FIG. 8, since 10 cycles of the recording cycle tJET (JET_NUM=10) are present in the cycle of normal single ejection, successive ink ejection can be performed 10 times by the successive ejection operation within the cycle of normal single ejection.

Method of Determining Successive Ejection Frequency

Figure 9:
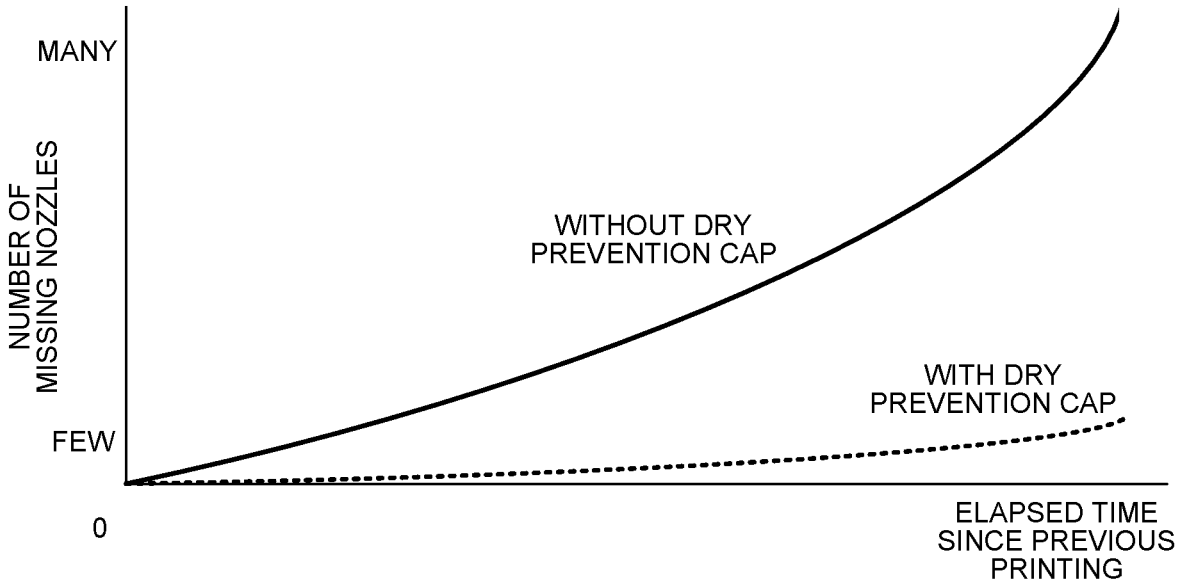
FIG. 9 illustrates a graph representing an example of a correlation between elapsed time from a previous printing and the number of missing nozzles.

FIG. 9 illustrates a graph representing an example of a correlation between elapsed time from a previous printing and the number of missing nozzles. A method of determining the number of times of ink ejection (successive ejection frequency) in the successive ejection operation performed by the hand-held printer 1 according to the present embodiment will be described with referring to FIG. 9.

The nozzle unit of the recording head has a characteristic that ink gets solidified when time of contact with air becomes long. Therefore, in common serial ink-jet printers, a control of capping with a dry prevention cap is performed after a print operation is finished. However, even if the capping is performed, it is practically impossible to maintain ink in the nozzle unit in a complete ejection enabled state, and there is a case of performing an idle jet to remove clogged ink before a print operation.

The hand-held printer 1 according to the present embodiment is a printer that is moved on the printing medium 20 by a user. A motor or the like to implement a user's operation of capping is not provided in the hand-held printer 1. Therefore, the capping is a user dependent operation. That is, when a print operation is not performed with the hand-held printer 1, it is necessary for the user to manually perform the capping with the dry prevention cap by placing the hand-held printer 1 on a stand on which the dry prevention cap is provided.

In FIG. 9, a graph represents a relationship between elapsed time after a previous print operation and the number of dots at which an ink ejection has failed due to nozzle clogging (hereinafter, it may be referred to as "missing nozzle") with respect to contrastive cases of the nozzle unit with/without the dry prevention cap. As illustrated in FIG. 9, it can be found that, as the elapsed time after the previous print operation increases, the number of missing nozzles increases. Moreover, in comparison with the case where the dry prevention cap is used, the number of occurrence of missing nozzles prominently becomes larger in the case where the dry prevention cap is not used. However, the tendency to increase the number of missing nozzles to some extent can be also observed in the case where the dry prevention cap is used.

In a case of thermal inkjet printers, when the dry prevention cap is used, the number of missing nozzles is to be around 0 to 6 dots in a condition where it is left for one day, although it is dependent on a nozzle diameter and a formula of ink. When the dry prevention cap is not used, the number of missing nozzles, which is equivalent to that in the case using the dry prevention cap with the elapsed time of one day, can occur with the elapsed time of one minute.

Therefore, in the hand-held printer 1 according to the present embodiment, the successive ejection frequency is determined to be larger as left standing time (elapsed time) increases and is determined by acquiring elapsed time to which a weight is added depending on whether or not the dry prevention cap is used. The hand-held printer 1 according to the present embodiment determines the successive ejection frequency based on an elapsed time Top calculated by, for example, Equation (5) below.

$$Top = k1 \times Top_cap + k2 \times Top_decap \quad (5)$$

In Equation (5), Top_cap denotes elapsed time in a state where the dry prevention cap is used, and Top_decap denotes elapsed time in a state where the dry prevention cap is not used. Moreover, k1 denotes a correction coefficient with respect to the elapsed time Top_cap in the state where the dry prevention cap is used, and k2 denotes a correction coefficient with respect to the elapsed time Top_decap in the state where the dry prevention cap is not used. The elapsed time described above may be elapsed time from a point of time when a previous printing is finished, or may be elapsed time from when the hand-held printer 1 receives image data to be printed from the external device 10.

By setting the correction coefficient k2 to be larger than the correction coefficient k1, a weight of the elapsed time Top_decap contributing to the elapsed time Top can be increased. For example, while k1 is set to 1.0, k2 is set to 2.0. By using such correction coefficients, a value depending on a type of ink and properties can be used as a coefficient.

Based on the elapsed time calculated by Equation (5) described above, the hand-held printer 1 according to the present embodiment can acquire the successive ejection frequency V as in Table 1 below.

TABLE 1

| Elapsed Time Top | Successive Ejection Frequency V |
|---|---|
| $0 \leq Top < T1$ | V1 |
| $T1 \leq Top < T2$ | V2 |
| $T2 \leq Top$ | V3 |

In the Table 1, it may be configured such that time thresholds T1=30 [sec] and T2=60 [sec], and successive ejection frequency V1=4, V2=7, and V3=10. It may be configured such that the correction coefficient k1 and k2, the time thresholds T1 and T2, and the successive ejection frequencies V1 to V3 can be set arbitrarily by a user via the external device 10 in accordance with the characteristics of ink to be used and the recording head 104. Moreover, divisions of the elapsed time are not limited to be divided into three sections as shown in Table 1, but may be divided into two sections, or four or more sections.

As described above, by determining the successive ejection frequency based on the elapsed time Top calculated by Equation (5) above, clogging of the respective nozzles in the recording head 104 can be effectively eliminated, and the hand-held printer 1 can correctly print an image desired by the user.

As described above, the capping detection sensor 110 detects whether the capping with the dry prevention cap is employed. The capping detection sensor 110 may be any of a transmission or a reflection optical sensor, a magnetic sensor that detects a magnet or the like mounted on the dry prevention cap, a physical push sensor, and the like.

Configuration of Functional Blocks of Hand-Held Printer

Figure 10:
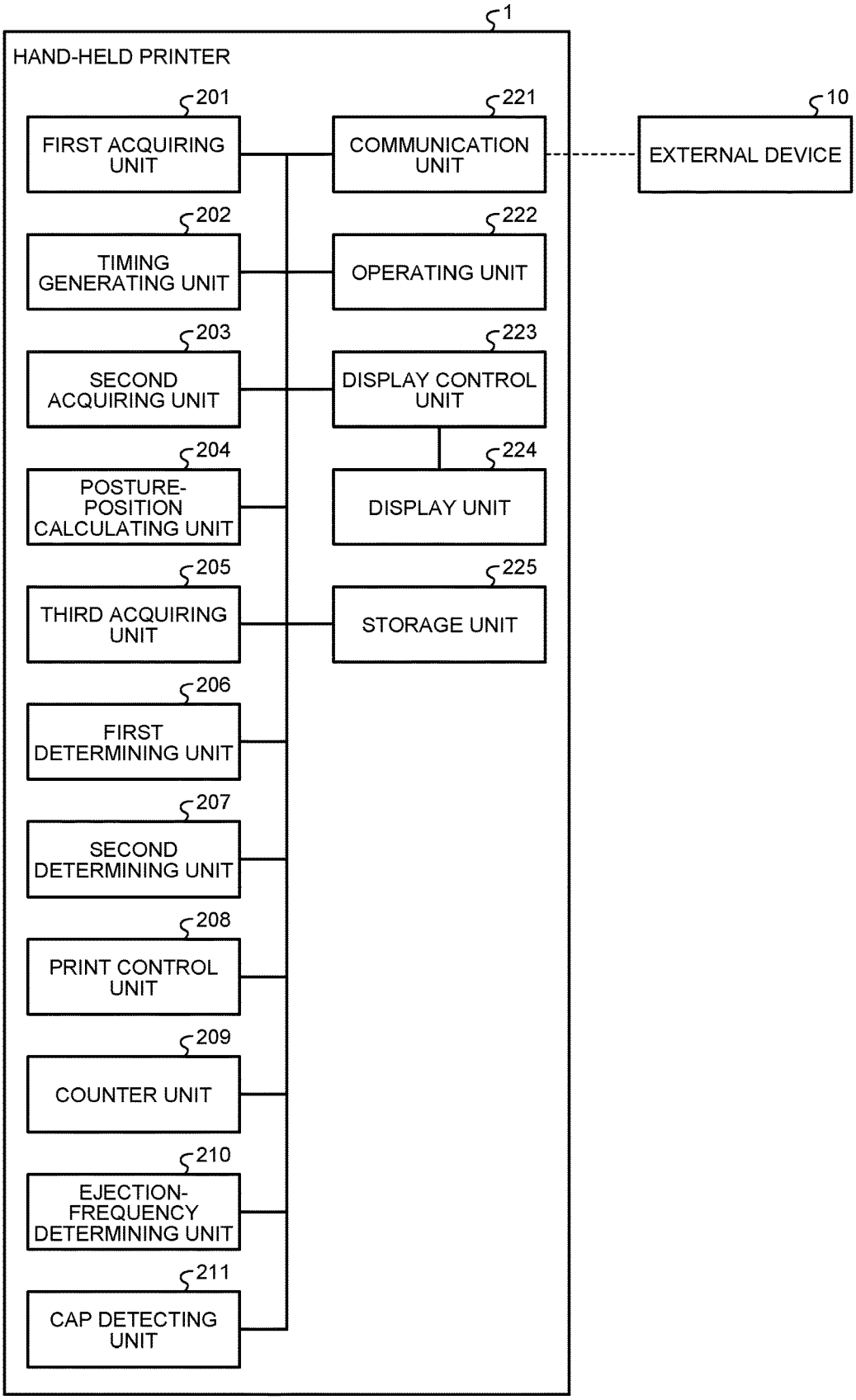
FIG. 10 illustrates an example of a configuration of functional blocks of the hand-held printer according to the embodiment.

FIG. 10 illustrates an example of a configuration of functional blocks of the hand-held printer according to the embodiment. A configuration of functional blocks of the hand-held printer 1 according to the present embodiment will be described with referring to FIG. 10.

As illustrated in FIG. 10, the hand-held printer 1 includes a first acquiring unit 201 (data acquiring unit), a timing generating unit 202, a second acquiring unit 203, a posture-position calculating unit 204, a third acquiring unit 205, a first determining unit 206, a second determining unit 207, a print control unit 208, a counter unit 209, an ejection-frequency determining unit 210 (determining unit), a cap detecting unit 211 (detecting unit), a communication unit 221, an operating unit 222, a display control unit 223, a display unit 224, and a storage unit 225.

The first acquiring unit 201 is a functional unit for acquiring a print job (image data) (an example of print data) from the external device 10. Moreover, the first acquiring unit 201 may acquire a print job (image data) that is stored in the storage unit 225.

The timing generating unit 202 is a functional unit for generating a timing signal representing a timing for acquiring posture position information by the second acquiring unit 203. The timing generating unit 202 further generates a timing signal representing an ejection timing in the print control of the recording head 104 by the print control unit 208. The timing generating unit 202 is implemented by the print/sensor-timing generating unit 46 illustrated in FIG. 4.

The second acquiring unit 203 is a functional unit for acquiring information (posture position information) about a posture and a position of the hand-held printer 1 detected by the navigation sensor 106*a* and the gyro sensor 106*b*. The second acquiring unit 203 is implemented by the navigation sensor I/F 45, the gyro sensor I/F 48, and an operating program that is executed by the CPU 31, each being illustrated in FIG. 4.

The posture-position calculating unit 204 is a functional unit for calculating a posture and a position of each of the nozzles of the recording head 104 by using the posture position information acquired by the second acquiring unit 203 from the navigation sensor 106*a* and the gyro sensor 106*b*. The reason why the posture-position calculating unit 204 can calculate the posture and the position of each individual nozzle is that, the positional relationships between the navigation sensor 106*a* and the respective nozzles are given in advance. The posture-position calculating unit 204 is implemented by the position calculating circuit 32 illustrated in FIG. 4.

The third acquiring unit 205 is a functional unit for acquiring a peripheral image in the image data that corresponds to a position of the nozzle calculated by the posture-position calculating unit 204. Moreover, the third acquiring unit 205 rotates the acquired peripheral image depending on a posture (angle) of the nozzle calculated by the posture-position calculating unit 204. The third acquiring unit 205 is implemented by the DMAC 42 and the rotator 43 illustrated in FIG. 4.

The first determining unit 206 is a functional unit for comparing a print position on the printing medium 20 of the image data (peripheral image) to be printed and the position of each of the nozzles of the recording head 104 calculated by the posture-position calculating unit 204, and determining whether the compared positions satisfy a predetermined condition (ejection condition). The predetermined condition (ejection condition) is, for example, a condition where the compared positions match with each other, or a condition where the compared positions are close to each other enough to be regarded as the both positions match with each other, or the like. The first determining unit 206 is implemented by the recording-head control unit 47 illustrated in FIG. 4.

The second determining unit 207 is a functional unit for determining, for each nozzle of the recording head 104, whether successive ejection operation is necessary when the recording head 104 performs a print operation based on the image data. Specifically, the second determining unit 207 determines whether the number of times of ejection from each nozzle of the recording head 104 counted by the counter unit 209 becomes equal to or larger than a predetermined threshold. As a result of the determination, the second determining unit 207 determines that the successive ejection operation is necessary for the nozzle whose ejection frequency is smaller than the threshold. The second determining unit 207 is implemented by the successive-ejection processing unit 49 illustrated in FIG. 4.

The predetermined threshold for the ejection frequency described above may be arbitrarily set from, for example, the external device 10.

The print control unit 208 is a functional unit for controlling operation of the recording-head control unit 47 and the successive-ejection processing unit 49 and causing the recording head 104 to perform a print operation. Moreover, when a print position on the printing medium 20 of the image data to be printed and the position of each nozzle of the recording head 104 satisfy a predetermined condition, the print control unit 208 performs control such that ink is ejected from a relevant nozzle in the recording head 104 in accordance with the timing signal representing an ejection timing generated by the timing generating unit 202.

The counter unit 209 is a functional unit for counting the number of times of ejection for each nozzle of the recording head 104. That is, a value counted by the counter unit 209 is obtained for each individual nozzle in the recording head 104. The number of times of the ejection operation counted by the counter unit 209 may be the number of times of ejection in the successive ejection operation, or may be the number of times of ejection of each nozzle irrespective of the successive ejection operation or the normal ejection operation (single ejection).

The ejection-frequency determining unit 210 is a functional unit for measuring elapsed time from a point of time when a previous print operation is finished, and determining, based on the measured elapsed time, the successive ejection frequency to be applied to the successive ejection operation by the hand-held printer 1. The method of acquiring the elapsed time is as described above. A starting point of the elapsed time is not limited to the point of time when a previous print operation is finished, but may be, for example, a point of time when image data to be printed is received from the external device 10 (point of time when image data is acquired by the first acquiring unit 201).

The cap detecting unit 211 is a functional unit for detecting whether the dry prevention cap is used or not by receiving a detection signal from the capping detection sensor 110, which represents whether or not the nozzle unit of the recording head 104 of the hand-held printer 1 is capped with the dry prevention cap.

The communication unit 221 is a functional unit for performing data communication with the external device 10. The communication unit 221 receives, for example, a print jog (image data) from the external device 10. Moreover, the communication unit 221 transmits information about an operating state of a print operation, information about a current operating mode, information about a remaining amount of ink of the recording head 104, information indicating an abnormality of the hand-held printer 1, and the like to the external device 10. The communication unit 221 is implemented by the communication I/F 105 illustrated in FIG. 3 and an operating program that is executed by the CPU 31 illustrated in FIG. 4.

The operating unit 222 is a functional unit for receiving an operation input by the user. The operating unit 222 is implemented by the OPU 107 illustrated in FIG. 3 (for instance, the operating button 5 in FIG. 1).

The display control unit 223 is a functional unit for controlling a display operation of the display unit 224.

The display unit 224 is a functional unit for displaying operating states of the hand-held printer 1 in accordance with the control of the display control unit 223. The display unit 224 displays, for example, a state where normal printing is in process, a state where image data reception is in process, and the like, as the operating state of the hand-held printer 1. The display unit 224 is implemented by the OPU 107 illustrated in FIG. 3 (for instance, the LED 8 in FIG. 1).

The storage unit 225 is a functional unit for storing various kinds of programs, firmware to control respective devices, driving waveform data to drive the recording head 104, a print job (image data) received from the external device 10, various kinds of setting values, and the like. The storage unit 225 is implemented by the DRAM 102*b* illustrated in FIG. 3.

The first acquiring unit 201, the print control unit 208, the counter unit 209, the ejection-frequency determining unit 210, and the cap detecting unit 211 are implemented by an operating program executed by the CPU 31 illustrated in FIG. 3. Note that part of or all these functional units may be implemented not by the operating program as software but by the ASIC/FPGA 60.

The respective functional units illustrated in FIG. 10 are conceptual illustration of functions, and are not limited to the configuration as illustrated. For example, two or more functional units illustrated in FIG. 10 as independent functional units may be configured as a single functional unit. Conversely, functions of a single functional unit in FIG. 10 may be separated to be configured as two or more functional units.

Print Operation of Hand-Held Printer

Figure 11:
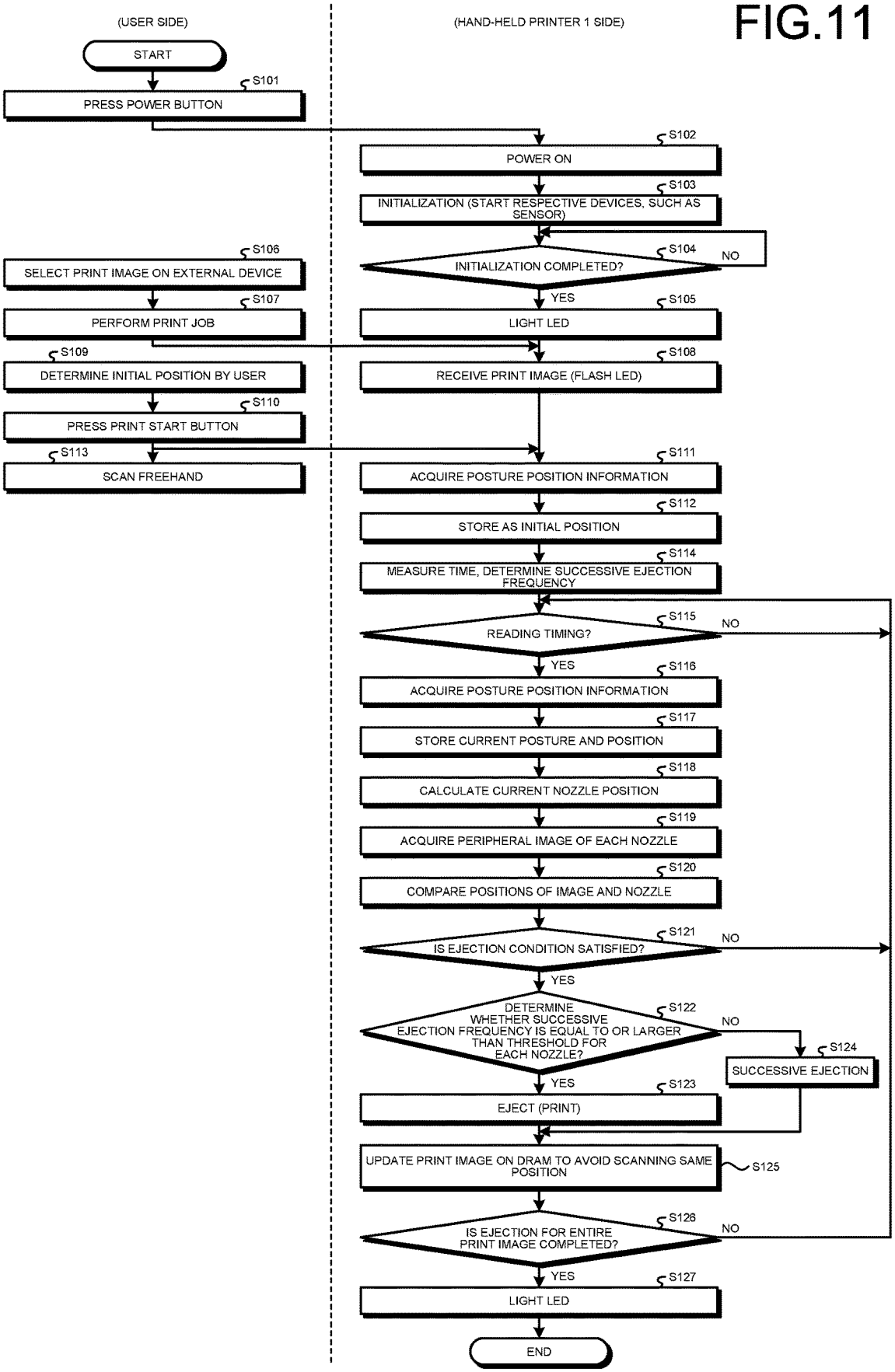
FIG. 11 illustrates a flowchart representing an example of the print operation of the hand-held printer according to the embodiment.

FIG. 11 is a flowchart representing an example of the print operation of the hand-held printer according to the embodiment. The print operation of the hand-held printer 1 according to the present embodiment will be described with referring to FIG. 11.

<Step S101>

First, the user presses a power button of the hand-held printer 1. The power button is, for example, the operating button 5 illustrated in FIG. 1. Processing is forwarded to step S102.

<Step S102>

The hand-held printer 1 is shifted to the power-on state. The respective devices of the hand-held printer 1 are supplied with power from the power source 108 through the power source circuit 109. Processing is forwarded to step S103.

<Step S103>

The respective devices of the control unit 101, the navigation sensor 106*a*, the gyro sensor 106*b*, and the capping detection sensor 110 are initialized and started. Processing is forwarded to step S104.

<Step S104>

When the initialization of the respective devices: the control unit 101; the navigation sensor 106*a*; the gyro sensor 106*b*; and the capping detection sensor 110 is completed (step S104: YES), processing is forwarded to step S105. When the initialization has not been completed (step S104: NO), processing stands by for completion of the initialization.

<Step S105>

When the initialization is completed, the display control unit 223 displays a state where the initialization is completed and a print operation is enabled by lighting the LED 8 being the display unit 224. Processing is forwarded to step S108.

<Steps S106 and S107>

The user operates the external device 10 and selects image data (or image) to be printed (for example, tagged image file format (TIFF) data, joint photographic experts group (JPEG) data, or the like). The user then performs an operation to perform a print operation with the selected image data (image to be printed) as a print job. The print job is transmitted from the external device 10 to the hand-held printer 1. Processing is forwarded to step S108.

<Step S108>

When the print job (image to be printed or image data) is received by the communication unit 221 from the external device 10, the display control unit 223 displays a state where the print job is received, for example, by flashing the LED 8, and the like being the display unit 224. The first acquiring unit 201 then acquires the print job received by the communication unit 221. Processing is forwarded to step S111.

<Steps S109 and S110>

The user holds the hand-held printer 1 and decides an initial position to print the image on the printing medium 20. The user then performs an operation input (for example, depression of a button corresponding to print start) to start printing on the operating unit 222. Processing is forwarded to step S111 and step S113.

<Step S111>

When the print job is acquired by the first acquiring unit 201, the second acquiring unit 203 acquires posture position information about the hand-held printer 1 detected by the navigation sensor 106*a* and the gyro sensor 106*b*. Processing is forwarded to step S112.

<Step S112>

The posture-position calculating unit 204 calculates, as an initial position of each nozzle, a posture and a position of each individual nozzle of the recording head 104 by using the posture position information acquired by the second acquiring unit 203 from the navigation sensor 106*a* and the gyro sensor 106*b*. The posture-position calculating unit 204 then stores the calculated postures and positions in the storage unit 225. Processing is forwarded to step S114.

<Step S113>

The user holds the hand-held printer 1 and starts the freehand scanning after determining the initial position to print the image on the printing medium 20.

<Step S114>

After the initial position is calculated by the posture-position calculating unit 204, the timing generating unit 202 starts time measurement to generate a timing signal for acquiring posture position information by the navigation sensor 106*a* and the gyro sensor 106*b*. Until this point, the ejection-frequency determining unit 210 has measured elapsed time from a point of time when a previous print operation is finished. Then, the ejection-frequency determining unit 210 determines, based on the measured elapsed time, the successive ejection frequency to be applied to the successive ejection operation of the hand-held printer 1. Processing is forwarded to step S115.

<Step S115>

When the timing signal generated by the timing generating unit 202 indicates that it comes to the timing for acquiring (reading) posture position information from the navigation sensor 106*a* and the gyro sensor 106*b* (step S115: YES), processing is forwarded to step S116. When it has not come to the timing (step S115: NO), processing stands by for the timing.

<Steps S116 and S117>

When it has come to the timing of acquiring (reading) posture position information from the navigation sensor 106*a* and the gyro sensor 106*b*, the second acquiring unit 203 acquires the posture position information on the hand-held printer 1 detected by the navigation sensor 106*a* and the gyro sensor 106*b* and stores the acquired information in the storage unit 225. Accordingly, the second acquiring unit 203 acquires posture position information for each timing signal generated by the timing generating unit 202. The information (amount of movement) acquired by the navigation sensor 106*a* and the information (angular speed) acquired by the gyro sensor 106*b* are necessary to calculate a current two-dimensional position to the initial position. Thus, timings of the both acquisitions are preferable to be matched. Processing is forwarded to Step S118.

<Steps S118 and S119>

The posture-position calculating unit 204 calculates a current posture and a current position of each individual nozzle of the recording head 104 by using posture position information currently acquired by the second acquiring unit 203 from the navigation sensor 106*a* and the gyro sensor 106*b*. The third acquiring unit 205 acquires a peripheral image in the image data of the print job corresponding to the position of a nozzle calculated by the posture-position calculating unit 204. Processing is forwarded to Step S120.

<Steps S120 and S121>

The first determining unit 206 compares a print position of the image data to be printed (peripheral image) on the printing medium 20 and a position of each nozzle of the recording head 104 calculated by the posture-position calculating unit 204. Then, the first determining unit 206 determines whether the compared positions satisfy a predetermined condition (ejection condition). When it is determined that the compared positions satisfy the predetermined condition (ejection condition) as a result of the determination (step S121: YES), processing is forwarded to step S122.

When the compared positions do not satisfy the condition (step S121: NO), processing is returned to step S115.

<Step S122>

When the first determining unit 206 determines that the compared positions satisfy the predetermined condition (ejection condition), the second determining unit 207 determines whether the successive ejection operation is necessary for the nozzle of the recording head 104 that satisfies the ejection condition. Specifically, the second determining unit 207 determines whether or not the number of times of ejection from the nozzle counted by the counter unit 209 is equal to or larger than a threshold. When the number of times of ejection from the nozzle is equal to or larger than the threshold (step S122: YES), it is determined not to perform the successive ejection operation but to perform the normal ejection operation, and processing is forwarded to step S123. On the other hand, when the number of times of ejection from the nozzle is smaller than the threshold (step S122: NO), it is determined to perform the successive ejection operation, and processing is forwarded to step S124.

<Step S123>

The print control unit 208 performs printing by ejecting ink from a relevant nozzle of the recording head 104 in accordance with the timing signal generated by the timing generating unit 202, which represents a cycle of a normal single ejection, such that ink is ejected at the print position satisfying the ejection condition. The counter unit 209 counts the number of times of the ink ejection from the relevant nozzle and stores the counted number in the storage unit 225 in association with information on the relevant nozzle. Processing is forwarded to step S125.

<Step S124>

The print control unit 208 performs printing by carrying out the successive ejection operation. In the successive ejection operation, the print control unit 208 causes ink to be ejected at the print position satisfying the ejection condition as many times as the above-mentioned successive ejection frequency from the nozzle that has been determined to have the necessity of the successive ejection operation. The successive ejection operation is performed in accordance with the timing signal (for example, the timing signal timgen_trg illustrated in FIG. 8) representing a cycle of the successive ejection operation generated by the timing generating unit 202. The counter unit 209 counts the number of times of ejection from the relevant nozzle and stores the counted number of times in the storage unit 225 in association with information on the relevant nozzle.

Furthermore, when the number of times of ejection, which is counted during the successive ejection operation, does not reach the predetermined threshold of step S122 described above, the successive ejection operation is performed again at a next print position to which the hand-held printer 1 is scanned, where the next print position satisfies the ejection condition. The repetition of the successive ejection operation is continued until the ejection frequency reaches the predetermined threshold. When the counted number of times of ejection from the relevant nozzle is smaller than the predetermined threshold described above, it is determined that the successive ejection operation has been already performed at least one cycle. In this case, when the successive ejection operation is performed again, the successive ejection operation may be performed with the successive ejection frequency determined by the ejection-frequency determining unit 210.

Processing is forwarded to step S125.

<Step S125>

After ink is ejected at the print position satisfying the ejection condition, the print control unit 208 updates the image data by setting a flag, which indicates compression of printing, on a pixel corresponding to the print position in the image data (image to be printed) that is stored in the storage unit 225 (DRAM 102*b*). Thus, when the nozzle comes to a position at which ink has already been printed by scanning by the user with the hand-held printer 1, it is possible to determine whether print should be performed at the position by referring to the above-mentioned flag that has been set on a pixel corresponding to the relevant position in the image data. When the flag is set, it represents that printing has already been performed at the position. In this case, it is determined that further printing at this position is not necessary. Processing is forwarded to Step S126.

<Step S126>

When print (ejection) is completed for the entire part of the image data (image to be printed) of the print job (step S126: YES), processing is forwarded to step S127. When print is not completed (step S126: NO), processing is returned to step S115. By repeating steps S115 to S126 described above, the entire image to be printed is formed on the printing medium 20.

<Step S127>

When print (ejection) is completed for the entire part of the image data (image to be printed) on the printing medium 20, the display control unit 223 displays a state where the print operation has been completed, for example, by lighting the LED 8 or the like being the display unit 224. Note that even if print of the entire part of the image data has not been completed, when the user determines that it is sufficiently printed, it can be regarded as completion of the print operation by an operation input of print completion with respect to the operating unit 222 by the user.

By the procedures of steps S101 to S127 as described above, the print operation of the hand-held printer 1 is performed.

As described above, in the hand-held printer 1 according to the present embodiment, print is performed at a print position, which is determined as satisfying a given ejection condition, by successively ejecting ink as many times as the predetermined successive ejection frequency from a nozzle that is determined to have the necessity of the successive ejection operation. Thus, it is possible to eliminate nozzle clogging without performing idle ejection before printing, and possible to obtain the readability of print. Moreover, since a pre-printing operation, such as idle ejection, is not necessary, the usability is not deteriorated.

Furthermore, in the hand-held printer 1 according to the present embodiment, the successive ejection operation is repeated until the number of times of ejection, which is counted in association with the relevant nozzle, reaches a predetermined threshold. Thus, elimination of nozzle clogging of the recording head 104 can be ensured.

Moreover, in the hand-held printer 1 according to the present embodiment, the ejection-frequency determining unit 210 measures elapsed time from a point of time when a previous printing operation is finished and dynamically determines, based on the measured elapsed time, the successive ejection frequency to be applied to the successive ejection operation performed by the hand-held printer 1. Specifically, the ejection-frequency determining unit 210 acquires elapsed time with considering a condition on whether the nozzle unit of the recording head 104 is capped with the dry prevention cap, and determines the successive ejection frequency based on the acquired elapsed time. Thus, nozzle clogging of the recording head 104 can be effectively eliminated. The starting point of the elapsed time is not limited to the point of time when a previous print operation is finished, but it may be, for example, a point of time when image data to be printed is received from the external device 10.

Modification of Embodiment

A hand-held printer according to a modification of the present embodiment will be described mainly about a point different from the hand-held printer 1 according to the present embodiment. In the embodiment described above, elapsed time is acquired with considering a detection result of whether capping is employed or not, and the successive ejection frequency is determined based on the elapsed time. In the present modification, an operation of determining the successive ejection frequency with further considering temperature and humidity will be described.

<Hardware Configuration of Hand-Held Printer>

Figure 12:
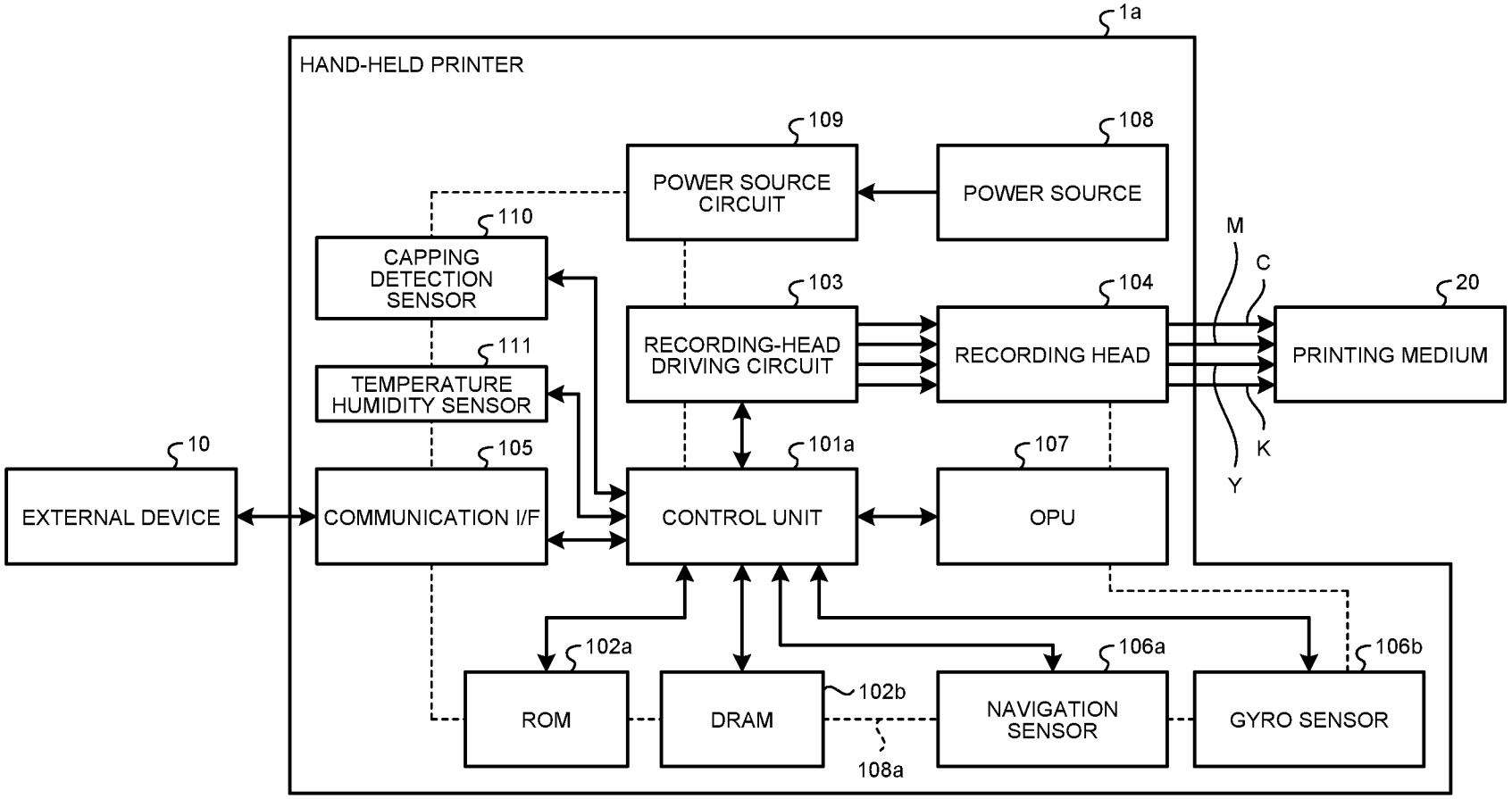
FIG. 12 illustrates an example of a hardware configuration of the hand-held printer according to a modification of the embodiment.
Figure 13:
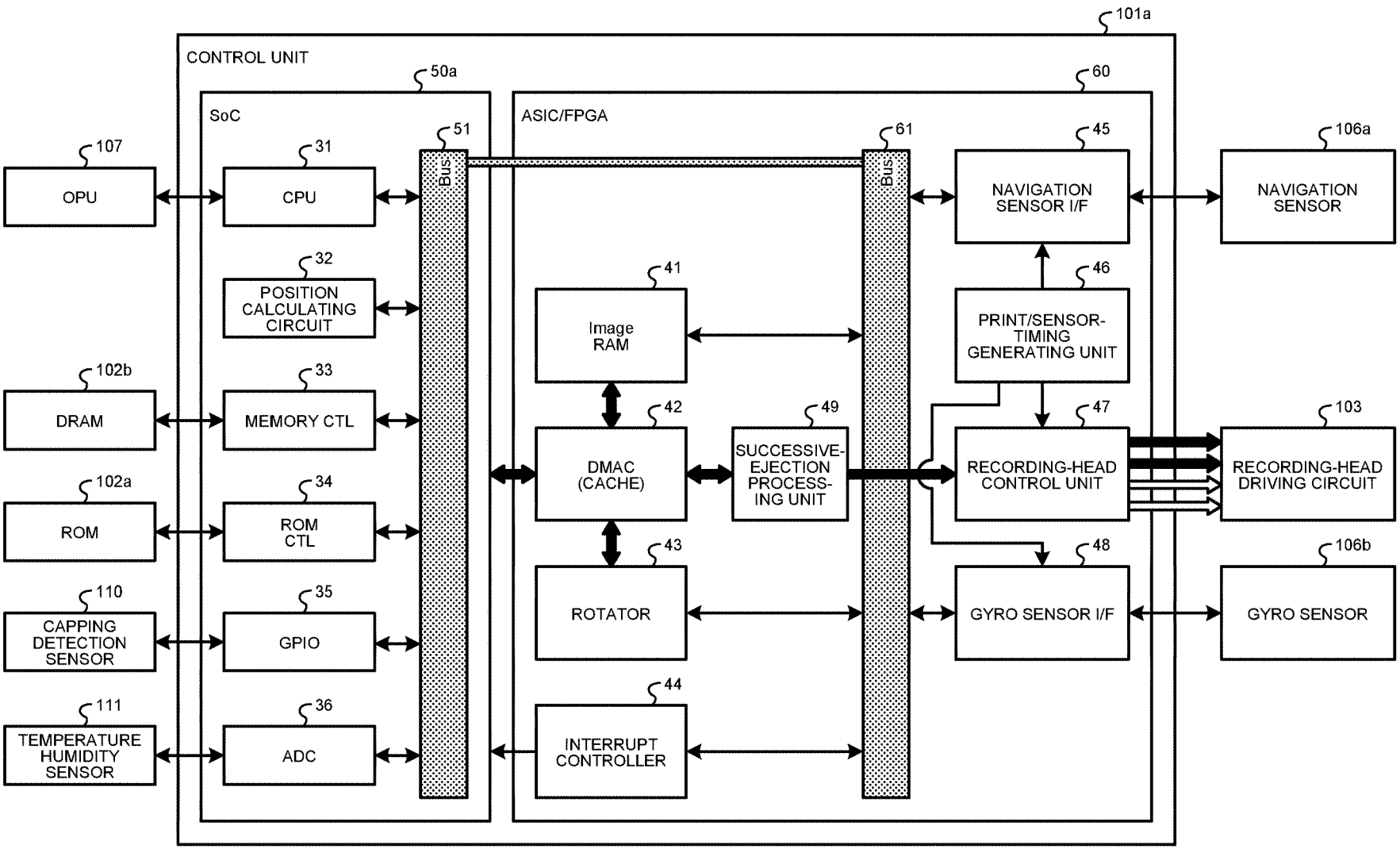
FIG. 13 illustrates an example of a configuration of a control unit of a hand-held printer according to the modification of the embodiment.

FIG. 12 illustrates an example of a hardware configuration of the hand-held printer according to the modification of the embodiment. FIG. 13 illustrates an example of a configuration of a control unit of the hand-held printer according to the modification of the embodiment. A hardware configuration of a hand-held printer 1*a* according to the present embodiment will be described with referring to FIG. 12 and FIG. 13.

The hand-held printer 1*a* according to the present modification is an example of an image recording apparatus that forms an image on the printing medium 20. The entire movement of the hand-held printer 1*a* is controlled by a control unit 101*a*. As illustrated in FIG. 12, the ROM 102*a*, the DRAM 102*b*, the recording-head driving circuit 103, the communication I/F 105, the navigation sensor 106*a*, the gyro sensor 106*b*, the OPU 107, the capping detection sensor 110, and a temperature humidity sensor 111 are electrically connected to the control unit 101*a*. Moreover, since the hand-held printer 1*a* is driven by the electric power, the hand-held printer 1*a* includes the power source 108 and the power source circuit 109. The electric power generated by the power source circuit 109 is supplied, through wirings indicated by the dotted line 108*a* in FIG. 12, to the control unit 101*a*, the ROM 102*a*, the DRAM 102*b*, the recording-head driving circuit 103, a recording head 104, the communication I/F 105, the navigation sensor 106*a*, the gyro sensor 106*b*, the OPU 107, the capping detection sensor 110, and the temperature humidity sensor 111.

The temperature humidity sensor 111 is a sensor that detects temperature and humidity of an environment in which the hand-held printer 1*a* is used.

The control unit 101*a* is provided with the CPU 31 illustrated in FIG. 13 and is a control board that controls the entire hand-held printer 1*a*. The control unit 101*a* performs determination of a position of each nozzle of the recording head 104, determination of an image to be formed according to the position, determination on whether an ejection condition described later is satisfied, and the like based on the amount of movement detected by the navigation sensor 106*a* and the angular speed detected by the gyro sensor 106*b*. Details of the control unit 101*a* will be described later with referring to FIG. 13.

As illustrated in FIG. 13, the control unit 101*a* includes a SoC 50*a* and the ASIC/FPGA 60. The SoC 50*a* and the ASIC/FPGA 60 communicate with each other through the buses 51 and 61. Furthermore, the SoC 50*a* and the ASIC/FPGA 60 may be formed in one chip or board, instead of separate chips. Alternatively, the SoC 50*a* and the ASIC/FPGA 60 may be implemented with three or more chips or boards.

The SoC 50*a* includes the CPU 31, a position calculating circuit 32, a memory CTL 33, the ROM CTL 34, the GPIO 35, an analog-to-digital convertor (ADC) 36, and the like. Components of the SoC 50*a* are not limited to these ones.

The ADC 36 is a circuit that is configured to convert an analog signal representing temperature and humidity output from the temperature humidity sensor 111 into digital information data. When the temperature humidity sensor 111 is a sensor that outputs a digital signal, a genera-purpose interface, such as a serial peripheral interface SPI and an inter-integrated circuit (I2C), may be used in place of the ADC 36.

Note that other components of the hand-held printer 1*a* and the control unit 101*a* are the same as those described in FIG. 3 and FIG. 4 above. Moreover, the hardware configuration of the hand-held printer 1*a* illustrated in FIG. 12 and FIG. 13 is an example. Components other than the components illustrated in FIG. 12 and FIG. 13 may be employed. Moreover, the respective functions of the SoC 50*a* and the ASIC/FPGA 60 may be distributed to either of them depending on a performance of the CPU 31 and a circuit scale or the like of the ASIC/FPGA 60.

Method of Determining Successive Ejection Frequency

Next, a method of determining a successive ejection frequency to be applied to the successive ejection operation of in the hand-held printer 1*a* according to the present modification will be described.

As described above, the nozzle unit of the recording head has a characteristic that ink gets solidified when time of contact with air becomes long. Moreover, in addition to elapsed time of contact with air, a clogging state of ink may vary depending on temperature and humidity of an environment where the hand-held printer including the recording head is present. Table 2 below represents an example in which a missing nozzle level, which indicates frequency of occurrence of missing nozzles, varies depending on values of temperature and humidity.

TABLE 2

| | Missing Nozzle Level | | |
|---|---|---|---|
| | Temperature: L | Temperature: M | Temperature: H |
| Humidity: H | 1 | 2 | 3 |
| Humidity: M | 2 | 3 | 4 |
| Humidity: L | 3 | 4 | 5 |

In Table 2, it is represented that the larger the value of the missing nozzle level is, the higher the frequency of occurrence of missing nozzles. Moreover, "L" in Table 2 indicates that temperature or humidity is low, "M" indicates that temperature or humidity is moderate, and "H" indicated that temperature or humidity is high. Although it varies depending on a type and properties of ink used in the hand-held printer 1*a*, generally, ink has an aspect that it is solidified more easily when temperature is higher and humidity is lower as indicated in Table 2. Note that divisions of respective sections of "L", "M", and "H" in Table 2 may be achieved, for example, by threshold determination with respect to temperature and humidity. Moreover, the threshold in this case may be possible to be arbitrarily set by the user from the external device 10. Furthermore, divisions of temperature and humidity are not limited to be divided into three sections as indicated in Table 2, but may be divided into two, or four or more sections.

Accordingly, the hand-held printer 1*a* according to the present modification determines the successive ejection frequency to be applied to the successive ejection operation, for example, based on values of temperature and humidity detected by the temperature humidity sensor 111. Note that the hand-held printer 1*a* may be configured to determine the successive ejection frequency not only based on temperature and humidity, but also based on the elapsed time described in the above embodiment. For example, the hand-held printer 1*a* may determine the successive ejection frequency by using elapsed time obtained by multiplying elapsed time calculated based on Equation (5) described above by temperature and humidity detected by the temperature humidity sensor 111, and a correction coefficient according to the missing nozzle level determined as indicated in Table 2 above. The correction coefficient in this case may be set to a larger value as the missing nozzle level increases.

Configuration of Functional Blocks of Hand-Held Printer

Figure 14:
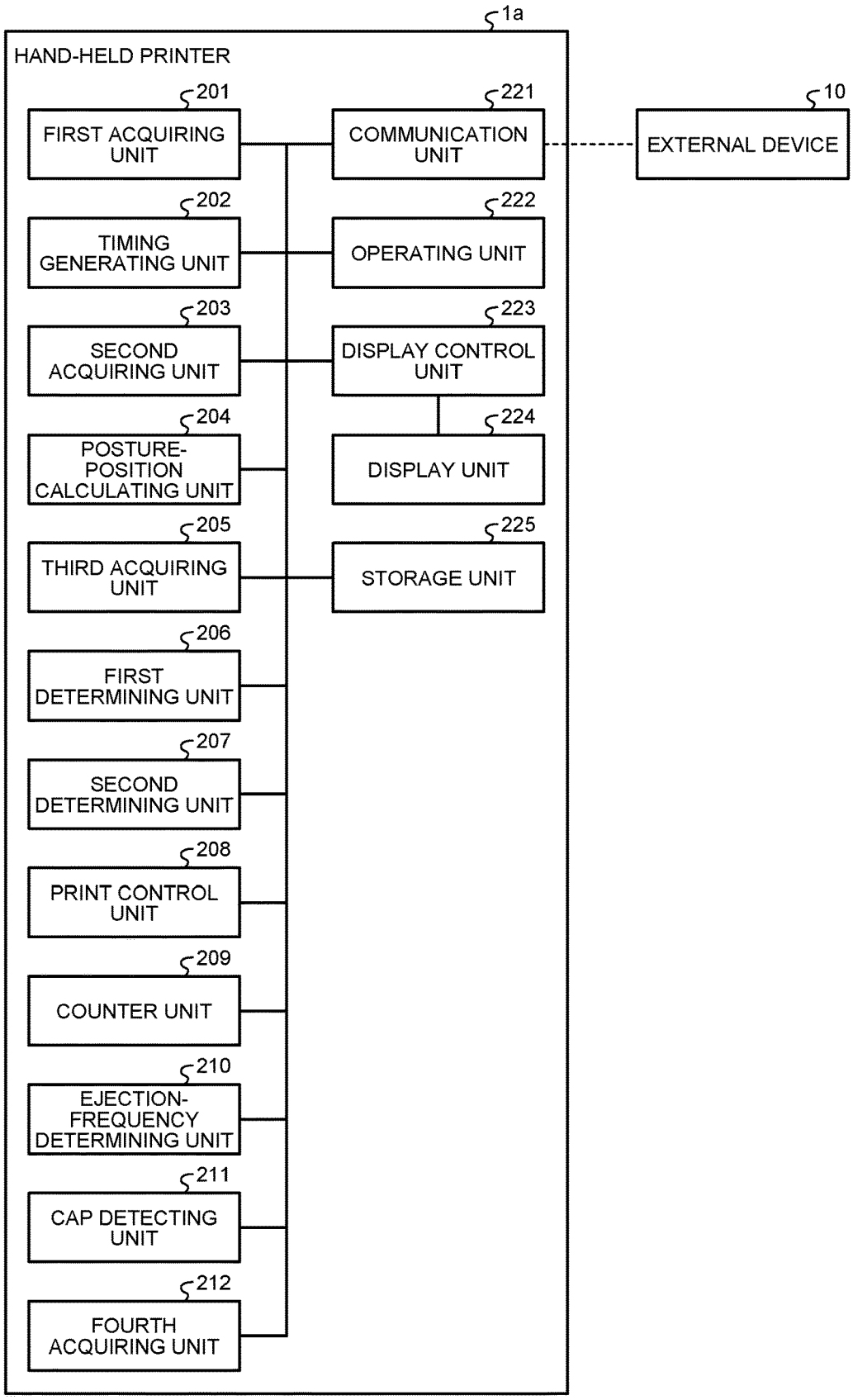
FIG. 14 illustrates an example of a configuration of functional blocks of the hand-held printer according to the modification of the embodiment.

FIG. 14 illustrates an example of a configuration of functional blocks of the hand-held printer according to the modification of the embodiment. A configuration of the functional blocks of the hand-held printer 1*a* according to the present modification will be described with referring to FIG. 14.

As illustrated in FIG. 14, the hand-held printer 1*a* includes the first acquiring unit 201 (data acquiring unit), the timing generating unit 202, the second acquiring unit 203, the posture-position calculating unit 204, the third acquiring unit 205, the first determining unit 206, the second determining unit 207, the print control unit 208, the counter unit 209, the ejection-frequency determining unit 210 (determining unit), the cap detecting unit 211 (detecting unit), a fourth acquiring unit 212 (temperature-humidity acquiring unit), the communication unit 221, the operating unit 222, the display control unit 223, the display unit 224, and the storage unit 225. Out of these units, functions of the respective functional units other than the ejection-frequency determining unit 210 and the fourth acquiring unit 212 are the same as those depicted in FIG. 10.

The fourth acquiring unit 212 is a functional unit for acquiring information on temperature and humidity (hereinafter, it may be referred to as temperature humidity information) detected by the temperature humidity sensor 111. The fourth acquiring unit 212 is implemented by the ADC 36 and an operating program executed by the CPU 31 illustrated in FIG. 13.

The ejection-frequency determining unit 210 is a functional unit for determining the successive ejection frequency to be applied to the successive ejection operation by the hand-held printer 1*a* based on the temperature humidity information acquired by the fourth acquiring unit 212. The ejection-frequency determining unit 210 may be configured to determine the successive ejection frequency based on the elapsed time considering a detection result of whether capping is employed by the cap detecting unit 211 other than the temperature humidity information, similarly to the embodiment described above.

Note that the respective functional units illustrated in FIG. 14 are conceptual illustration of functions, and are not limited to the configuration as illustrated. For example, two or more functional units illustrated as independent functional units in FIG. 14 may be configured as a single functional unit. Conversely, functions of a single functional unit in FIG. 14 may be separated to be configured as two or more functional units.

As described above, the hand-held printer 1*a* according to the present modification determines the successive ejection frequency based on temperature and humidity detected by the temperature humidity sensor 111, and performs the successive ejection operation to which the successive ejection frequency is applied. As described above, the successive ejection frequency may be determined based further on elapsed time considering a detection result of whether capping is employed by the cap detecting unit 211 in addition to the temperature humidity information. Thus, nozzle clogging of the recording head 104 can be effectively eliminated, so that the user can print a desired normal image by using the hand-held printer 1*a*.

In the embodiment and modification described above, when at least either one of the respective functions of the hand-held printers 1 and 1*a* is implemented by executing a computer program, the computer program is provided, installed in a ROM or the like in advance. Moreover, the computer program executed in the hand-held printers 1 and 1*a* according to the embodiment and the modification described above may be recorded on a computer-readable recording medium, such as a compact disk read-only memory (CD-ROM), a flexible disk (FD), a compact disk-recordable (CD-R), and a digital versatile disk (DVD) in a file in an installable format or in an executable format, to be provided. Furthermore, the computer program executed in the hand-held printers 1 and 1*a* may be provided by storing in a computer connected to a network, such as the Internet, and by being downloaded through the network. Furthermore, the computer program executed in the hand-held printers 1 and 1*a* according to the embodiment and the modification described above may be configured to be provided or distributed through a network such as the Internet. Moreover, the computer program executed in the hand-held printer 1*a* according to the embodiment and the modification described above has a module structure including at least one of the respective functional units described above, and as actual hardware, the CPU 31 of the control units 101 and 101*a* reads and executes the computer program from the storage device (ROM 102*a* or the like) described above, and the respective functional units are thereby loaded on the main storage device to be generated.

According to the present invention, it is possible to ensure the readability of print without performing an idle ejection prior to printing.

The above-described embodiments are illustrative and do not limit the present invention. Thus, numerous additional modifications and variations are possible in light of the above teachings. For example, at least one element of different illustrative and exemplary embodiments herein may be combined with each other or substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of the present invention may be practiced otherwise than as specifically described herein.

The method steps, processes, or operations described herein are not to be construed as necessarily requiring their performance in the particular order discussed or illustrated, unless specifically identified as an order of performance or clearly identified through the context. It is also to be understood that additional or alternative steps may be employed.

Further, any of the above-described apparatus, devices or units can be implemented as a hardware apparatus, such as a special-purpose circuit or device, or as a hardware/software combination, such as a processor executing a software program.

Further, as described above, any one of the above-described and other methods of the present invention may be embodied in the form of a computer program stored in any kind of storage medium. Examples of storage mediums include, but are not limited to, flexible disk, hard disk, optical discs, magneto-optical discs, magnetic tapes, non-volatile memory, semiconductor memory, read-only-memory (ROM), etc.

Alternatively, any one of the above-described and other methods of the present invention may be implemented by an application specific integrated circuit (ASIC), a digital signal processor (DSP) or a field programmable gate array (FPGA), prepared by interconnecting an appropriate network of conventional component circuits or by a combination thereof with one or more conventional general purpose microprocessors or signal processors programmed accordingly.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA) and conventional circuit components arranged to perform the recited functions.

What is claimed is:

1. An image recording apparatus for printing an image on a printing medium, the image recording apparatus comprising:

a recording head including a plurality of nozzles from which ink is ejected;

a memory; and one or more hardware processors coupled to the recording head and the memory, the one or more processors being configured to:

determine, for each of the plurality of nozzles, whether a position of the corresponding nozzle is a position to eject ink;

determine whether a successive ejection operation is necessary for a nozzle out of the plurality of nozzles, whose position is determined as the position to eject ink; and control the recording head so that ink is successively ejected at the position to eject ink at a successive ejection frequency from the nozzle that is determined to have the necessity of the successive ejection operation, wherein the one or more hardware processors determine that the successive ejection operation is necessary in a case that a number of times of ejection of ink from the nozzle, whose position is the position to eject ink, is smaller than a predetermined threshold.

2. The image recording apparatus according to claim 1, wherein the one or more hardware processors repeat the successive ejection operation for the nozzle, whose position is the position to eject ink, until the number of times of ejection of ink reaches the predetermined threshold.

3. The image recording apparatus according to claim 1, wherein the predetermined threshold is configurable.

4. The image recording apparatus according to claim 1, wherein the successive ejection frequency to be applied to the successive ejection operation is variable.

5. The image recording apparatus according to claim 4, wherein the one or more hardware processors determine the successive ejection frequency to be applied to the successive ejection operation, based on elapsed time from a point of time when a print operation by the recording head is finished.

6. The image recording apparatus according to claim 5, wherein the one or more hardware processors detect whether the plurality of nozzles are capped with a cap, and determine the successive ejection frequency based further on elapsed time of the detected state of capping.

7. The image recording apparatus according to claim 5, wherein the one or more hardware processors acquire information on temperature and humidity from a temperature humidity sensor detecting temperature and humidity of an environment in which the image recording apparatus is used, and determine the successive ejection frequency based further on the acquired information on temperature and humidity.

8. The image recording apparatus according to claim 4, wherein the one or more hardware processors acquire print data from an external device, and determine the successive ejection frequency to be applied to the successive ejection operation, based on elapsed time from a point of time when the print data is acquired.

9. An image recording method implemented by a computer provided in an image recording apparatus for printing an image on a printing medium by ejecting ink from a plurality of nozzles of a recording head of the image recording apparatus, the image recording method comprising:

first determining, for each of the plurality of nozzles, whether a position of the corresponding nozzle is a position to eject ink;

second determining whether a successive ejection operation is necessary for a nozzle out of the plurality of nozzles, whose position is determined as the position to eject ink; and controlling the recording head so that ink is successively ejected at the position to eject ink at a successive ejection frequency from the nozzle that is determined to have the necessity of the successive ejection operation, wherein the second determining determines that the successive ejection operation is necessary in a case that a number of times of ejection of ink from the nozzle, whose position is the position to eject ink, is smaller than a predetermined threshold.

10. The image recording apparatus according to claim 9, further comprising repeating the successive ejection operation for the nozzle, whose position is the position to eject ink, until the number of times of ejection of ink reaches the predetermined threshold.

11. The image recording apparatus according to claim 9, wherein the predetermined threshold is configurable.

12. The image recording apparatus according to claim 9, wherein the successive ejection frequency to be applied to the successive ejection operation is variable.

13. The image recording apparatus according to claim 12, further comprising third determining the successive ejection frequency, to be applied to the successive ejection operation, based on elapsed time from a point of time when a print operation by the recording head is finished.

14. The image recording apparatus according to claim 13, further comprising:

detecting whether the plurality of nozzles are capped with a cap, wherein the third determining the successive ejection frequency is further based on elapsed time of the detected state of capping.

15. The image recording apparatus according to claim 13, further comprising:

acquiring information on temperature and humidity from a temperature humidity sensor detecting temperature and humidity of an environment in which the image recording apparatus is used, wherein the third determining the successive ejection frequency is further based on the acquired information on temperature and humidity.

16. The image recording apparatus according to claim 12, further comprising:

acquiring print data from an external device; and third determining the successive ejection frequency, to be applied to the successive ejection operation, based on elapsed time from a point of time when the print data is acquired.

17. A non-transitory computer-readable recording medium storing a computer executable program which, when executed by one or more hardware processors of a computer, cause the computer to:

determine, for each of a plurality of nozzles of a recording head of an image recording apparatus in which the computer is provided, whether a position of the corresponding nozzle is a position to eject ink;

determine whether a successive ejection operation is necessary for a nozzle out of the plurality of nozzles, whose position is determined as the position to eject ink; and control the recording head so that ink is successively ejected at the position to eject ink at a successive ejection frequency from the nozzle that is determined to have the necessity of the successive ejection operation, wherein the one or more hardware processors determine that the successive ejection operation is necessary in a case that a number of times of ejection of ink from the nozzle, whose position is the position to eject ink, is smaller than a predetermined threshold.

* * * * *